US012716221B2

(12) United States Patent
Jovel et al.

(10) Patent No.: US 12,716,221 B2
(45) Date of Patent: Aug. 25, 2026

(54) CONNECTED FAUCET SYSTEMS

(71) Applicant: AS America, Inc., Piscataway, NJ (US)

(72) Inventors: Claudia Marcela Jovel, Spring, TX (US); Karl Torres, Columbus, NJ (US); Stanimir Stoynov, Westfield, NJ (US)

(73) Assignee: AS America, Inc., Piscataway, NJ (US)

( * ) Notice: Subject to any disclaimer, the term of this patent is extended or adjusted under 35 U.S.C. 154(b) by 262 days.

(21) Appl. No.: 18/562,782

(22) PCT Filed: May 23, 2022

(86) PCT No.: PCT/US2022/030515
§ 371 (c)(1),
(2) Date: Nov. 20, 2023

(87) PCT Pub. No.: WO2022/251105
PCT Pub. Date: Dec. 1, 2022

(65) Prior Publication Data

US 2024/0218643 A1 Jul. 4, 2024

Related U.S. Application Data

(60) Provisional application No. 63/192,299, filed on May 24, 2021.

(51) Int. Cl.
*E03C 1/05* (2006.01)
*E03B 7/07* (2006.01)
(Continued)

(52) U.S. Cl.
CPC ..... *E03C 1/055* (2013.01); *E03B 7/075* (2013.01); *E03D 1/34* (2013.01); *E03D 5/10* (2013.01)

(58) Field of Classification Search
CPC ..... E03C 1/055; E03C 1/057
See application file for complete search history.

(56) References Cited

U.S. PATENT DOCUMENTS 7,177,725 B2 * 2/2007 Nortier ..... E03C 1/00 702/49
9,783,964 B2 * 10/2017 Thompson ..... G05B 15/02
(Continued)

FOREIGN PATENT DOCUMENTS

EP 3708719 A1 9/2020
WO WO2009-061857 A2 5/2009
(Continued)

OTHER PUBLICATIONS

PCT/US2022/030515 International Search Report, 2 pages, dated Sep. 1, 2022.
(Continued)

*Primary Examiner* — Reinaldo Sanchez-Medina
(74) *Attorney, Agent, or Firm* — Tyler A. Stevenson; Anna-lisa L. Gallo

(57) ABSTRACT

A connected faucet system comprising a plurality of faucets, each faucet associated with a presence sensor, a solenoid valve, a flow meter, and a controller, wherein the presence sensor, the solenoid valve, and the flow meter are in electrical communication with the controller, and a control system comprising the controllers and a computing device, wherein the controllers are configured to communicate with the computing device directly and/or via a gateway, the control system is configured to collect data from the presence sensors and the flow meters, and the control system is configured to determine a status of each faucet based on the data; a control system is configured to initiate an action based on the faucet status.

20 Claims, 21 Drawing Sheets

(51) Int. Cl.
*E03D 1/34* (2006.01)
*E03D 5/10* (2006.01)

(56) References Cited

U.S. PATENT DOCUMENTS

| | | | | |
|---|---|---|---|---|
| 11,064,844 | B2 * | 7/2021 | Braddock | F16K 31/02 |
| 11,662,267 | B2 * | 5/2023 | Rudd | F24D 19/1051 73/40 |
| 11,821,766 | B2 * | 11/2023 | Muir | H04W 4/38 |
| 11,971,328 | B2 * | 4/2024 | Davidson | G01M 3/2876 |
| 2002/0019709 | A1 * | 2/2002 | Segal | G07C 3/10 702/45 |
| 2011/0320140 | A1 | 12/2011 | Butler et al. | |
| 2016/0146376 | A1 | 5/2016 | Peel | |
| 2017/0254054 | A1 | 9/2017 | Dunki-Jacogs et al. | |
| 2018/0045599 | A1 * | 2/2018 | Larach | G08B 25/08 |
| 2018/0230681 | A1 * | 8/2018 | Poojary | E03B 7/072 |
| 2020/0270853 | A1 | 8/2020 | Le et al. | |
| 2020/0284006 | A1 * | 9/2020 | Kramer | E03D 5/105 |
| 2020/0299941 | A1 * | 9/2020 | Veros | G05D 7/0635 |
| 2020/0354932 | A1 | 11/2020 | Gunawardena et al. | |

FOREIGN PATENT DOCUMENTS

| | | | |
|---|---|---|---|
| WO | WO2009-061857 | A3 | 5/2009 |
| WO | WO2020028798 | A1 | 2/2020 |

OTHER PUBLICATIONS

Extended European Search Report for EP application No. 22811914.5, mail date Mar. 14, 2025, 15 pages.

* cited by examiner

CONNECTED FAUCET SYSTEMS

The disclosure relates to connected faucet systems and to faucet communication with internet connected devices to control performance and operation of faucets.

BACKGROUND

Automatic faucets, for example automatic faucets in commercial settings, may comprise a sensor to determine the presence of a person's hands, and configured to deliver water for a period of time for a person to wash one's hands. An automatic faucet may leak, not shut off at an appropriate time, or not dispense water for an appropriate time. Each of these scenarios may result in wasting water and/or electric power and may damage a faucet, bathroom, or building.

Desired is a system to improve efficiency of automatic faucets, for example, automatic faucets in commercial settings such as office buildings, transportation hubs, and the like.

SUMMARY

Accordingly, disclosed is a connected faucet system, comprising a plurality of faucets, each faucet associated with a presence sensor, a solenoid valve, a flow meter, and a controller, wherein the presence sensor, the solenoid valve, and the flow meter are in electrical communication with the controller; and a control system comprising the controllers and a computing device, wherein the controllers are configured to communicate with the computing device directly and/or via a gateway, the control system is configured to collect data from the presence sensors and the flow meters, and the control system is configured to determine a status of each faucet based on the data.

Also disclosed is a faucet system, comprising a faucet associated with a presence sensor, a solenoid valve, a flow meter, and a controller, wherein the presence sensor, the solenoid valve, and the flow meter are in electrical communication with the controller, wherein the controller is configured to be in wireless communication with a computing device and/or with a gateway.

In some embodiments, a control system is configured to initiate an action based on the faucet status.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
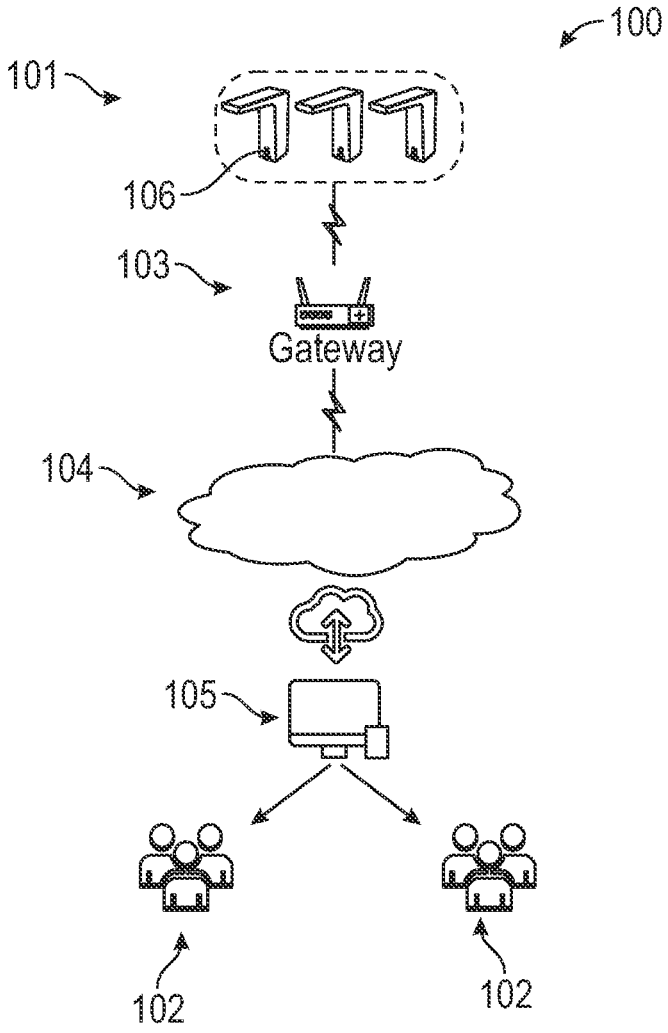
FIG. 1A, FIG. 1B, FIG. 1C, FIG. 1D, and FIG. 1E illustrate flow diagrams of a connected system, according to an embodiment.

FIG. 1A depicts connected system 100, according to an embodiment. Connected system 100 comprises plurality of faucets 101. Faucets 101 are connected to one or more technicians 102 via gateway 103, cloud/server 104, and computing device 105. Faucets 101 are associated with presence sensor 106, and a controller, solenoid valve, and a flow meter (all not visible). A control system of this embodiment comprises controllers, computing device 105, gateway 103, and cloud/server 104. The control system is configured to monitor faucets 101, collect data, determine a status of the faucets, and to initiate an action based on the status. Collected data may be communicated through gateway 102 to cloud/server 104, to technician's 102 computing device 105. A technician 102 may be for example a local custodian, a remote custodian, or an analyst. In an embodiment, sensed data may be communicated directly to computing device 105.

Figure 1B:
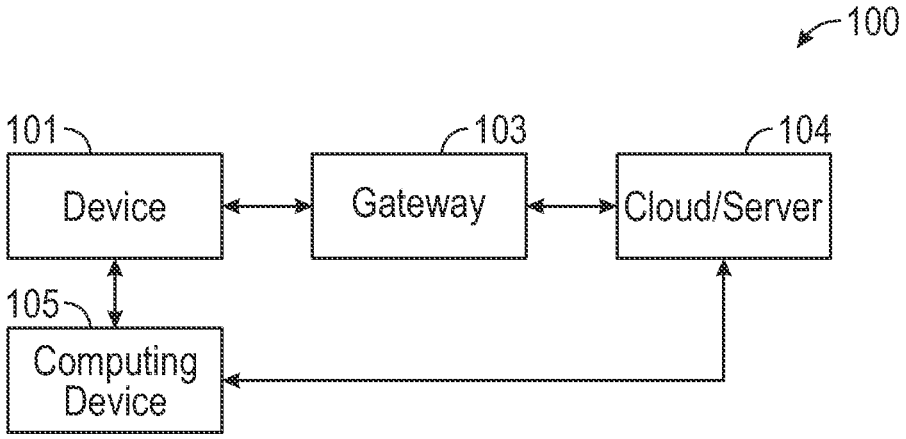

FIG. 1B shows a flow diagram for connected system 100, according to an embodiment. Faucet devices 101 are configured to communicate with gateway 103, which is configured to communicate with cloud/server 104. Cloud/server 104 is configured to communicate with computing device 105. All communication is configured to be two-way. Accordingly, a technician may connect to a faucet 101 directly with a smartphone (mobile device) or a laptop computing device. A technician may collect data and may initiate an action from a computing device, for example close an angle stop for a leaking faucet. In another embodiment, cloud/server 104 may analyze data from faucets 101, and may initiate an action based on the data via gateway 103 or computing device 105. Initiation of an action may comprise sending a command to a controller, whereupon a controller will, for example, send a command to a valve to open, close, or adjust. A computing device 105 may analyze data and determine a status, and may initiate an action based on the status. A computing device 105 may initiate an action by sending instructions directly to a controller associated with a faucet 101, or may initiate an action via cloud/server 104.

Figure 1C:
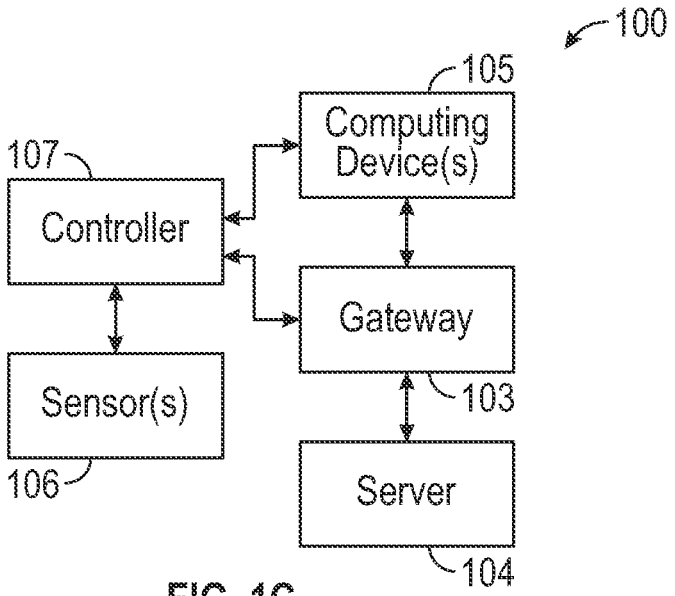

FIG. 1C shows a flow diagram for connected system 100, according to an embodiment. Faucets 101 are associated with controllers 107 and presence sensors 106. Faucets may also be associated with a flow meter, and one or more other sensors. Controller 107 is configured to monitor a faucet by collecting data from sensors 106, flow meters, and other sensors, and to communicate the data to a computing device 105 and/or a gateway 103. Cloud/server 104 may collect data from computing device 105 and/or gateway 103. Controllers 107 may communicate with computing device 105 either directly, or via gateway 103 and server 104. In some embodiments, a controller may be associated with a single faucet, or with a plurality of faucets.

Figure 1D:
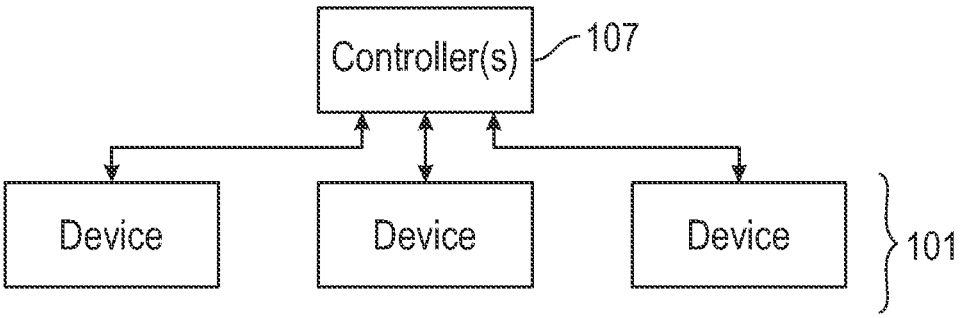
Figure 1E:
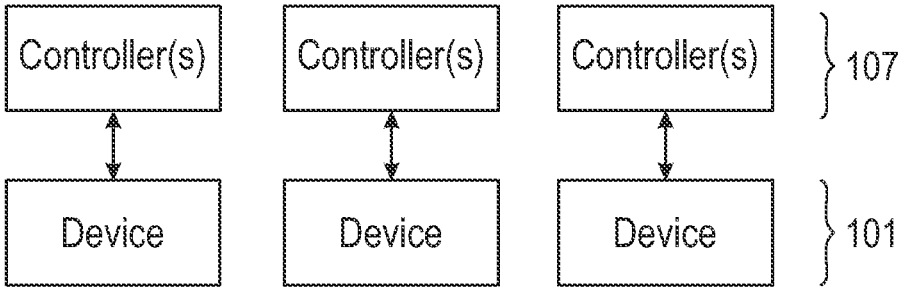

FIG. 1D and FIG. 1E illustrate a flow diagram for a portion of connected system 100, according to an embodiment. In an embodiment, a plurality of faucets 101 may be connected to a single controller 107, wherein controller 107 is in electrical communication with sensors associated with each faucet 101. In other embodiments, each faucet 101 may associated with a dedicated single controller. Controllers 107 may be positioned nearby faucet 101, or in other embodiments, may be positioned remote to a faucet 101. Controller 107 communication with sensors 106, flow meters, or other sensors may be via a wired or wireless connection.

Figure 1F:
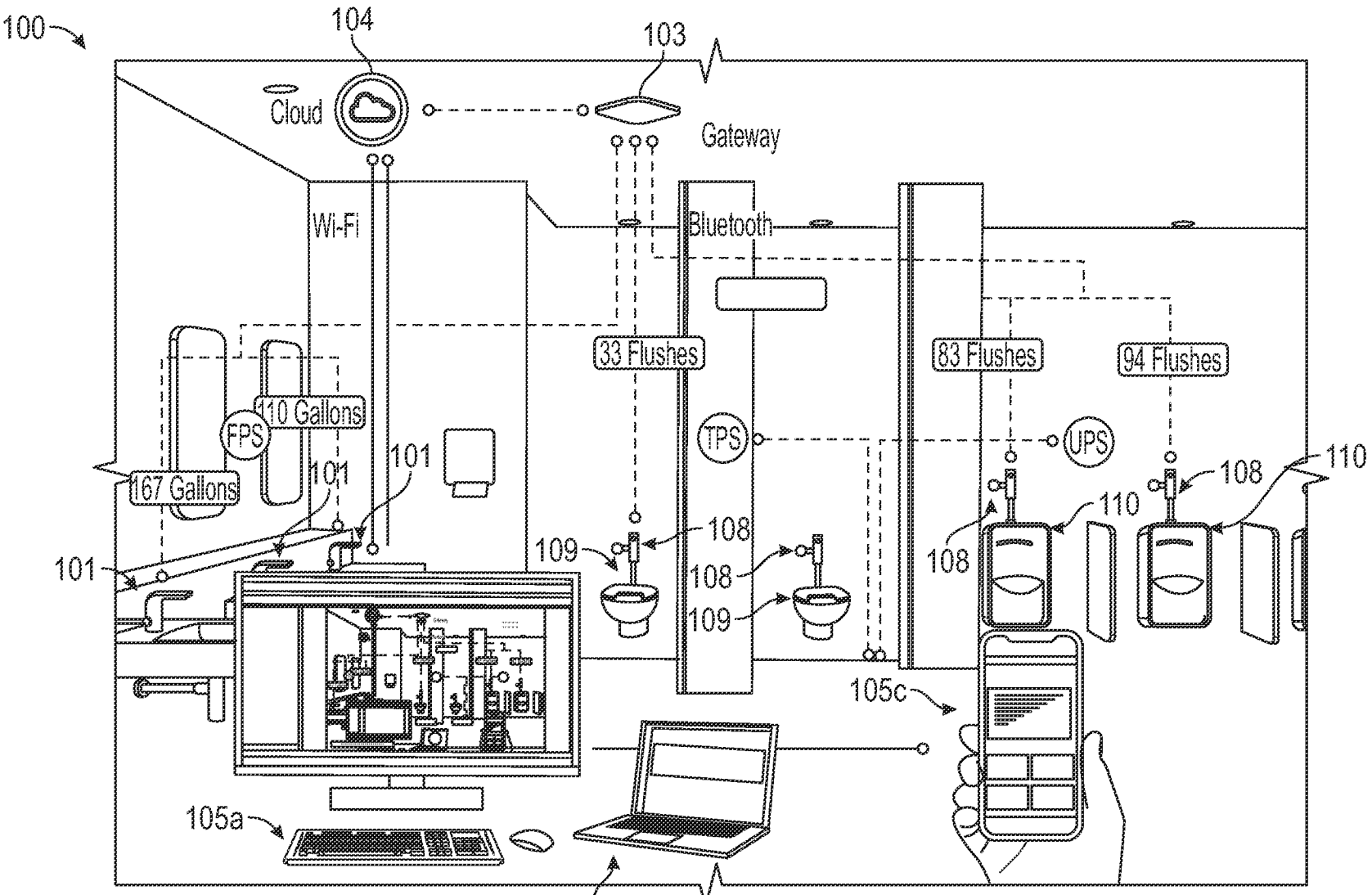
FIG. 1F illustrates a connected system, according to an embodiment.

FIG. 1F depicts connected system 100, according to an embodiment. System 100 comprises faucets 101. Faucets 101 are configured to communicate with gateway 103 and computing devices desktop computer 105*a*, laptop 105*b*, and smartphone 105*c*. Gateway 103 is configured to communicate with cloud/server 104. Cloud/server 104 is configured to communicate with computing devices 105*a*, 105*b*, and 105*c*. Connected system 100 comprises toilets 109 and urinals 110. Toilets 109 and urinals 110 are associated with flush valves 108, which may comprise a presence sensor in communication with a controller. In some embodiments, a single gateway may be employed per bathroom.

Figure 2A:
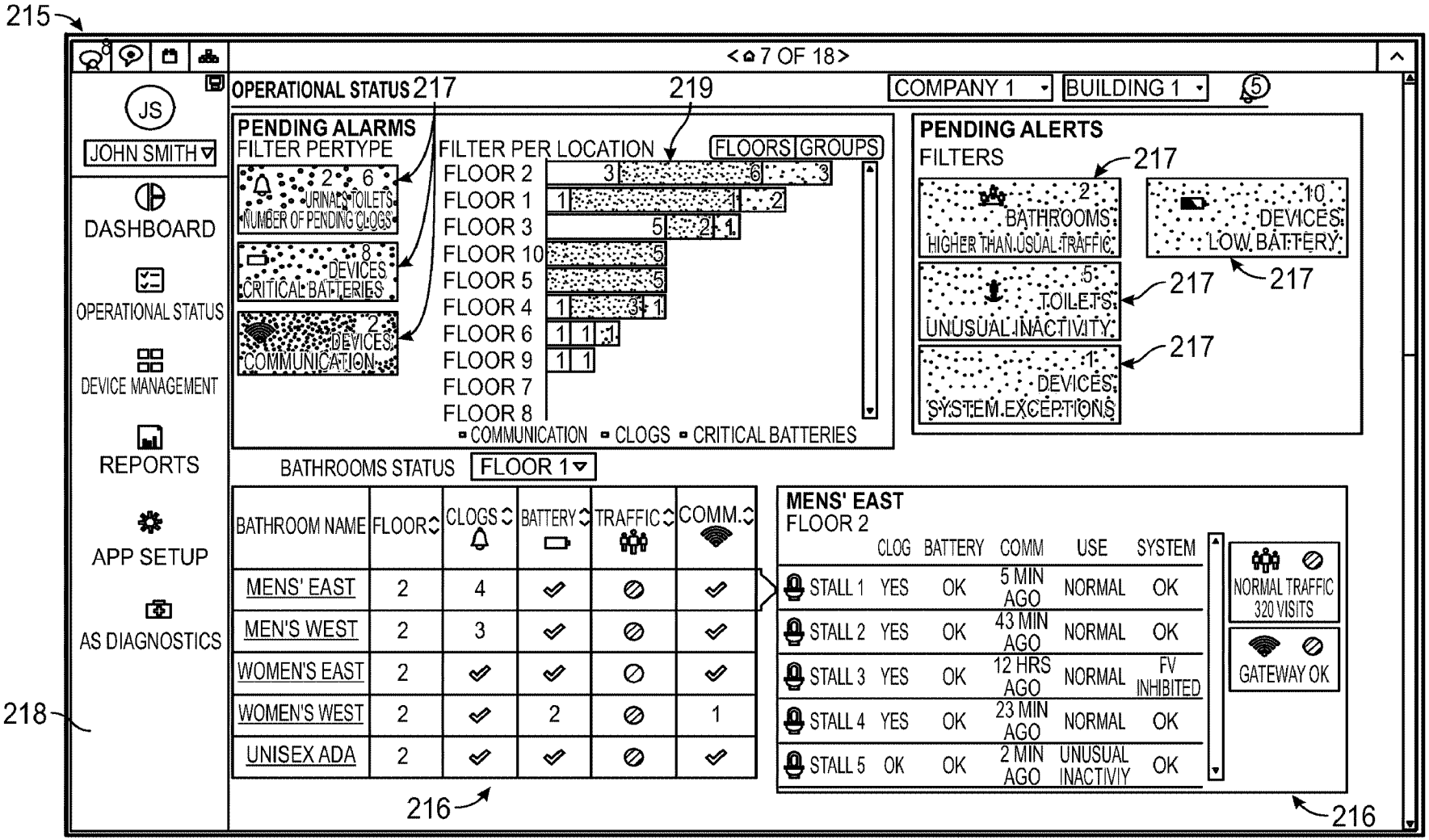
FIG. 2A, FIG. 2B, FIG. 2C, and FIG. 2D show a dashboard, according to some embodiments.
Figure 2B:
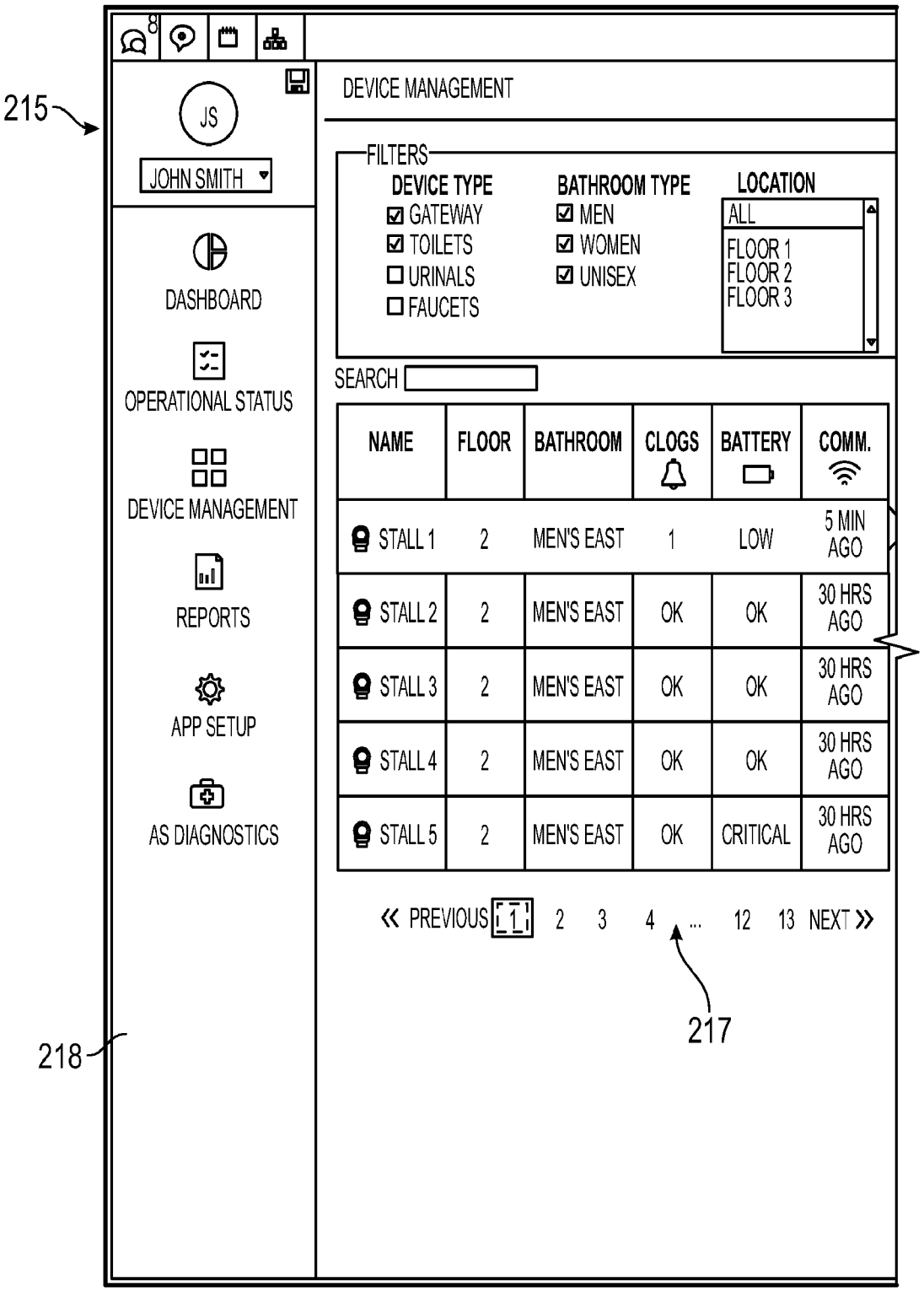
Figure 2B:
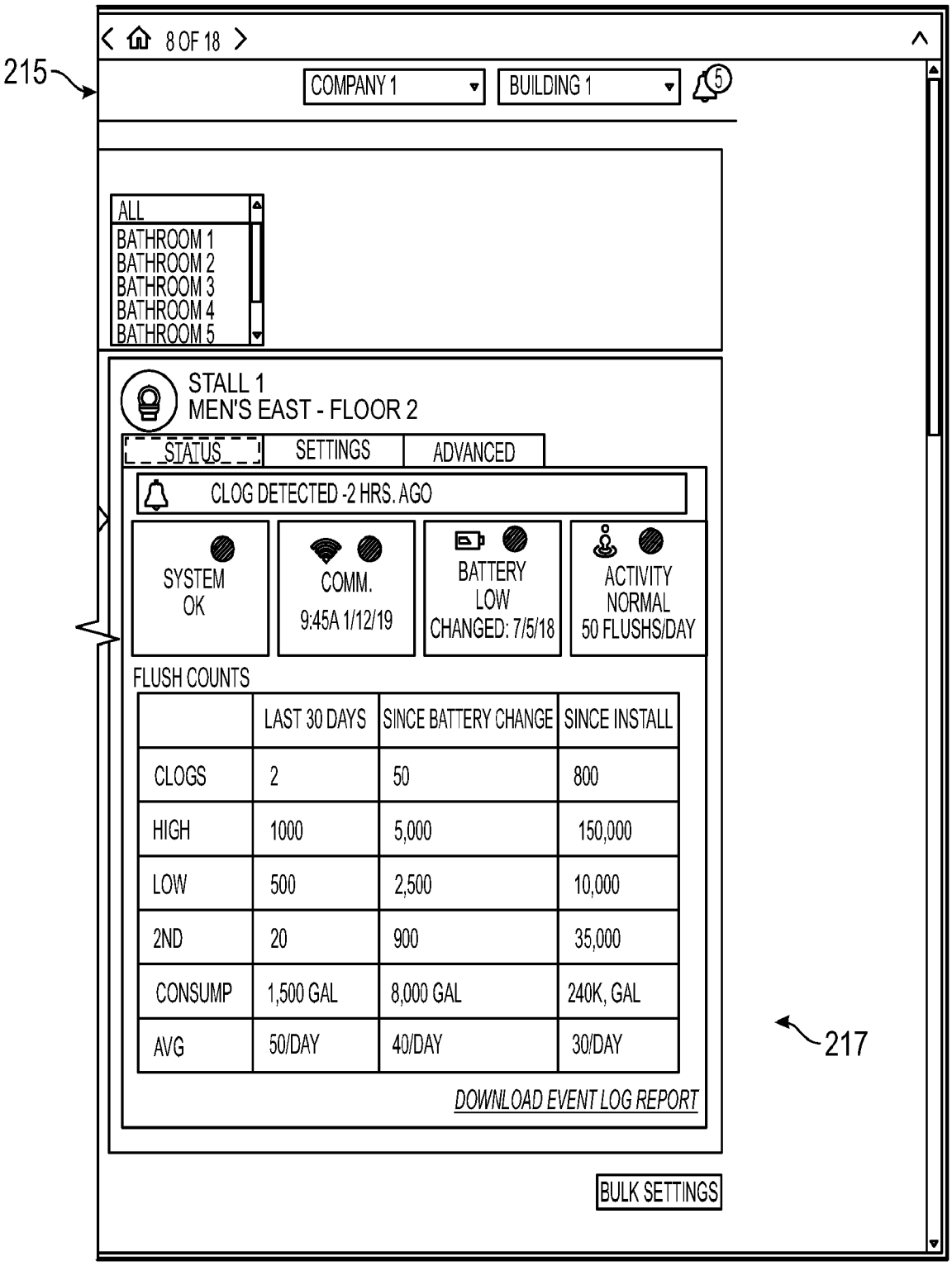

FIG. 2A and FIG. 2B illustrate a dashboard 215 may be set up and customized for a particular building, collection of buildings, rooms, floors, bathrooms, wings, etc., according to some embodiments. Accordingly, monitoring and control of a connected system may be customized. Dashboard 215 may include visual modules 216 associated with a connected system, for example connected system 100. Connected system 100 contains various men's, women's, and unisex bathrooms, at least some of which have multiple connected devices such as faucets and toilets. A technician or analyst 102 may monitor and control connected devices within each of the locations. Dashboard 215 may contain alerts or alarms 217. Alerts/alarms 217 may report battery life, bathroom traffic level, device status (normal/abnormal), device usage, water consumption per device, water usage per bathroom, water usage per building, etc. Dashboard 215 may contain navigation panel 218, configured to allow a technician to navigate between any number of web pages to monitor and control connected system 100. Dashboard 215 may contain notification module 219. Notification module 219 may organize alarms, communications, and/or status of the connected system by location, for instance by bathroom, by floor, by wing, by building, or combinations thereof.

Figure 2C:
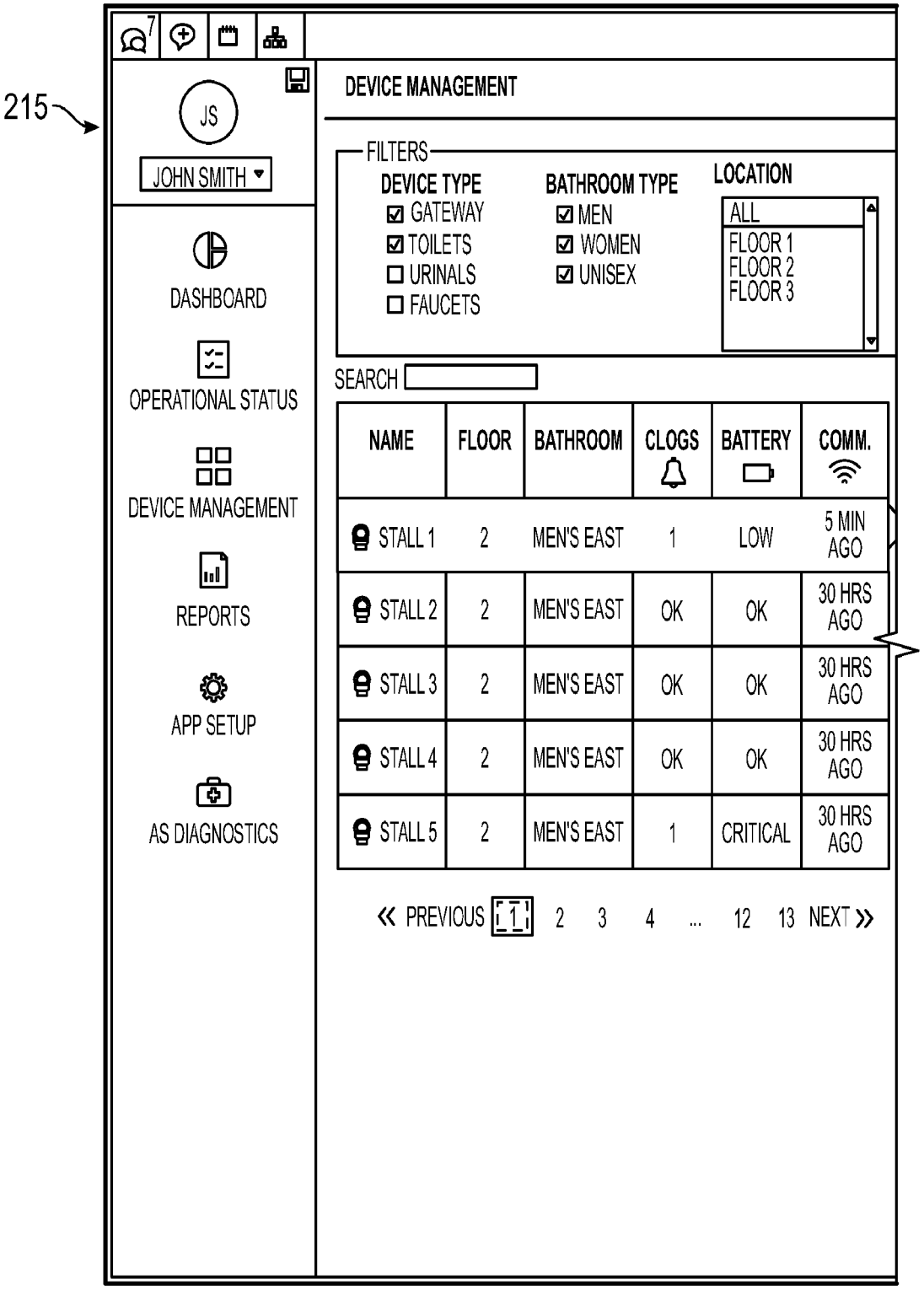
Figure 2C:
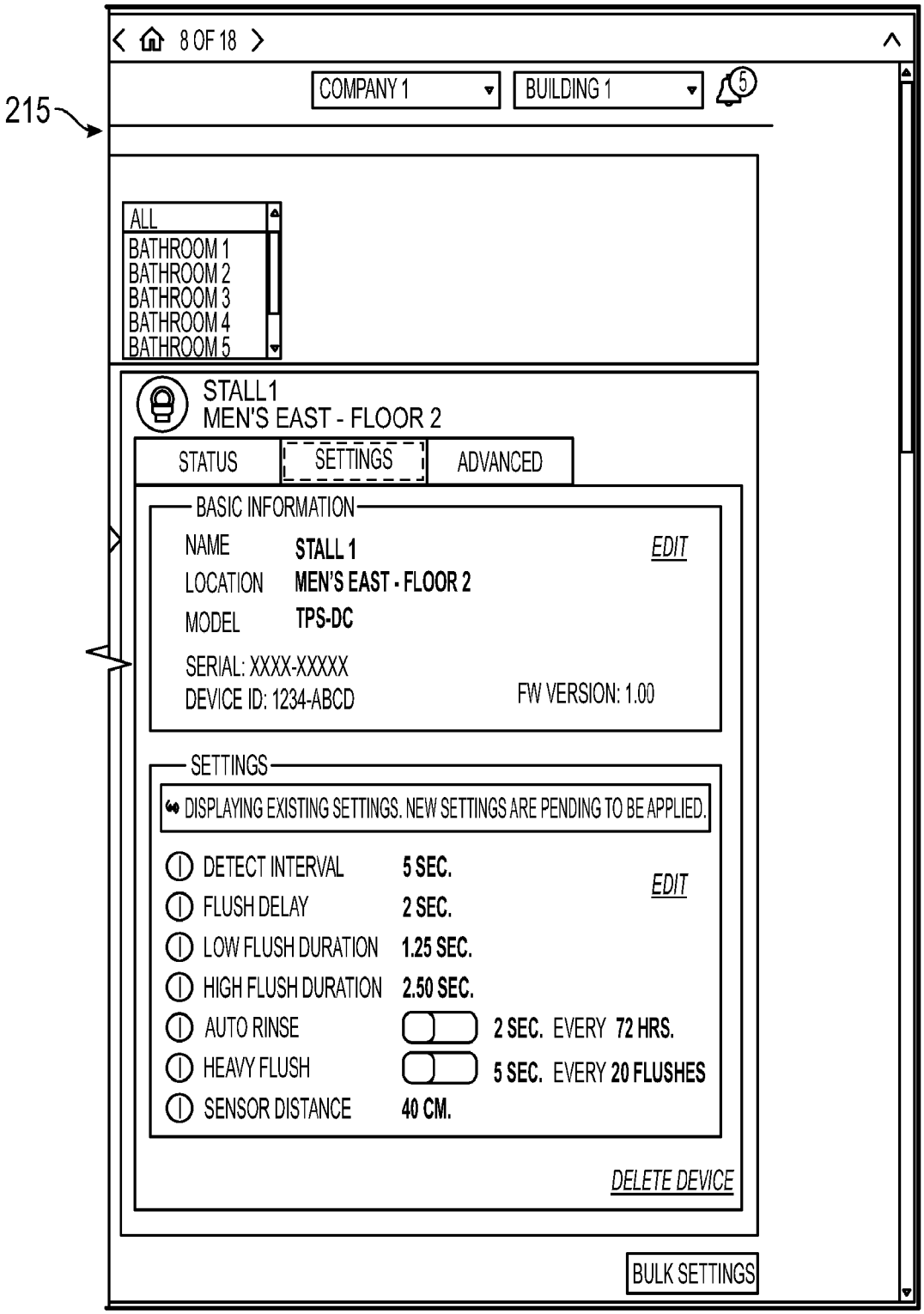
Figure 2D:
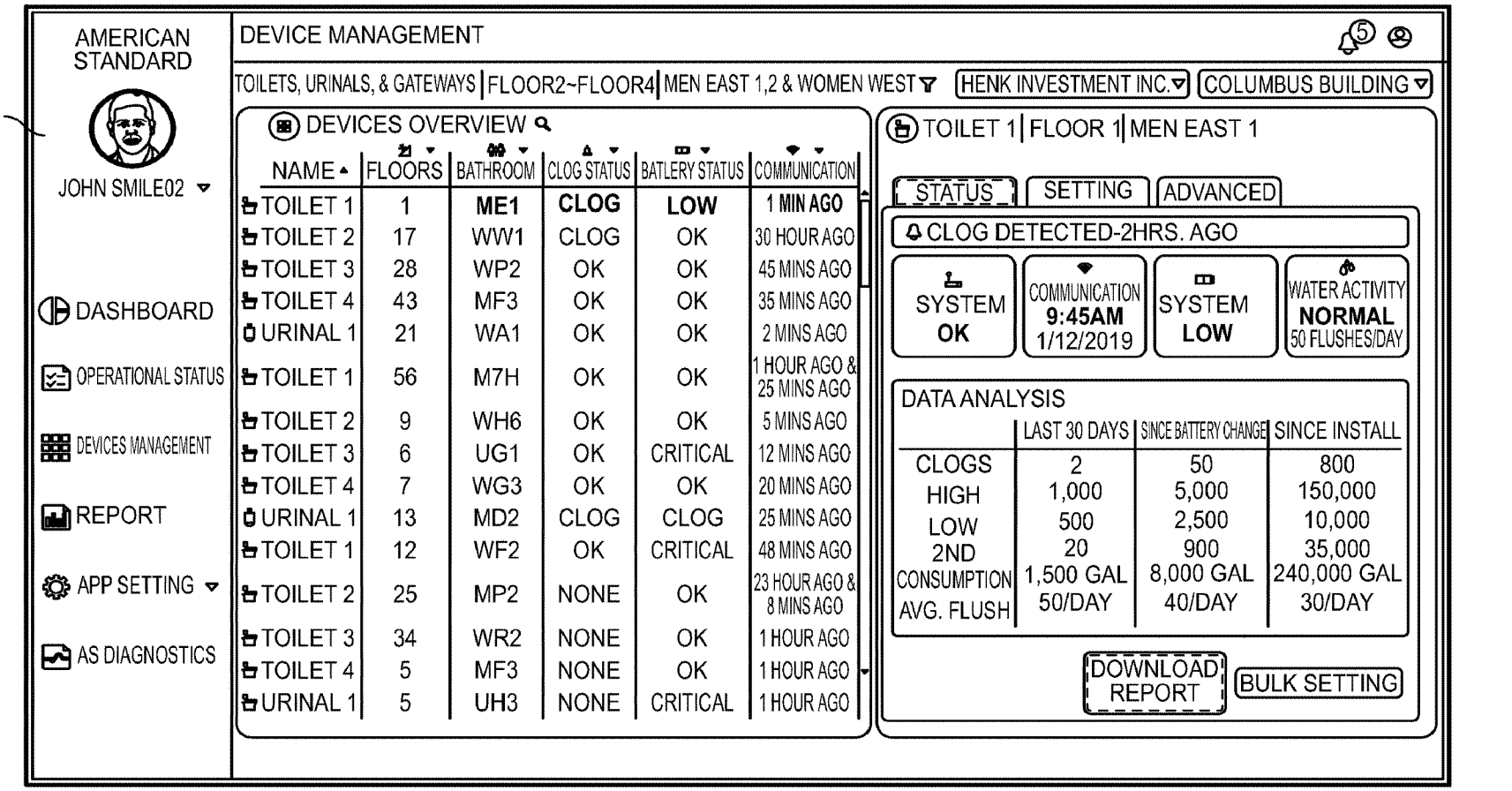

FIG. 2C and FIG. 2D illustrate a dashboard may allow for filtering of a device type (e.g. toilets, urinals, faucets, etc.), location (e.g. floor, wing, bathroom, building, campus, etc.), or combinations thereof. Dashboard 215 may allow for selection of a particular stall on a particular floor in a particular bathroom to review and analyze data associated with a device. Each device (e.g. flush valve, toilet, urinal, faucet, etc.) may have settings based on a preselected or predetermined profile, and may consider historical data of the device, bathroom, floor, building, etc. Settings may include time of detection interval, delay in flush, duration of a flush, duration of water flow, sensor performance, etc. Once filtered, a particular device (e.g. faucet) may be selected from a list to view a more detailed report. For example a report may show system status, communication status, last date and time of communication, battery status, water activity, number of uses per day, clogs, water consumption, average usage per time period, etc. Information may be viewed over any time period, for example, over the last 30 days, since a battery was changed, since installation, daily, during afternoons, etc.

Figure 3A:
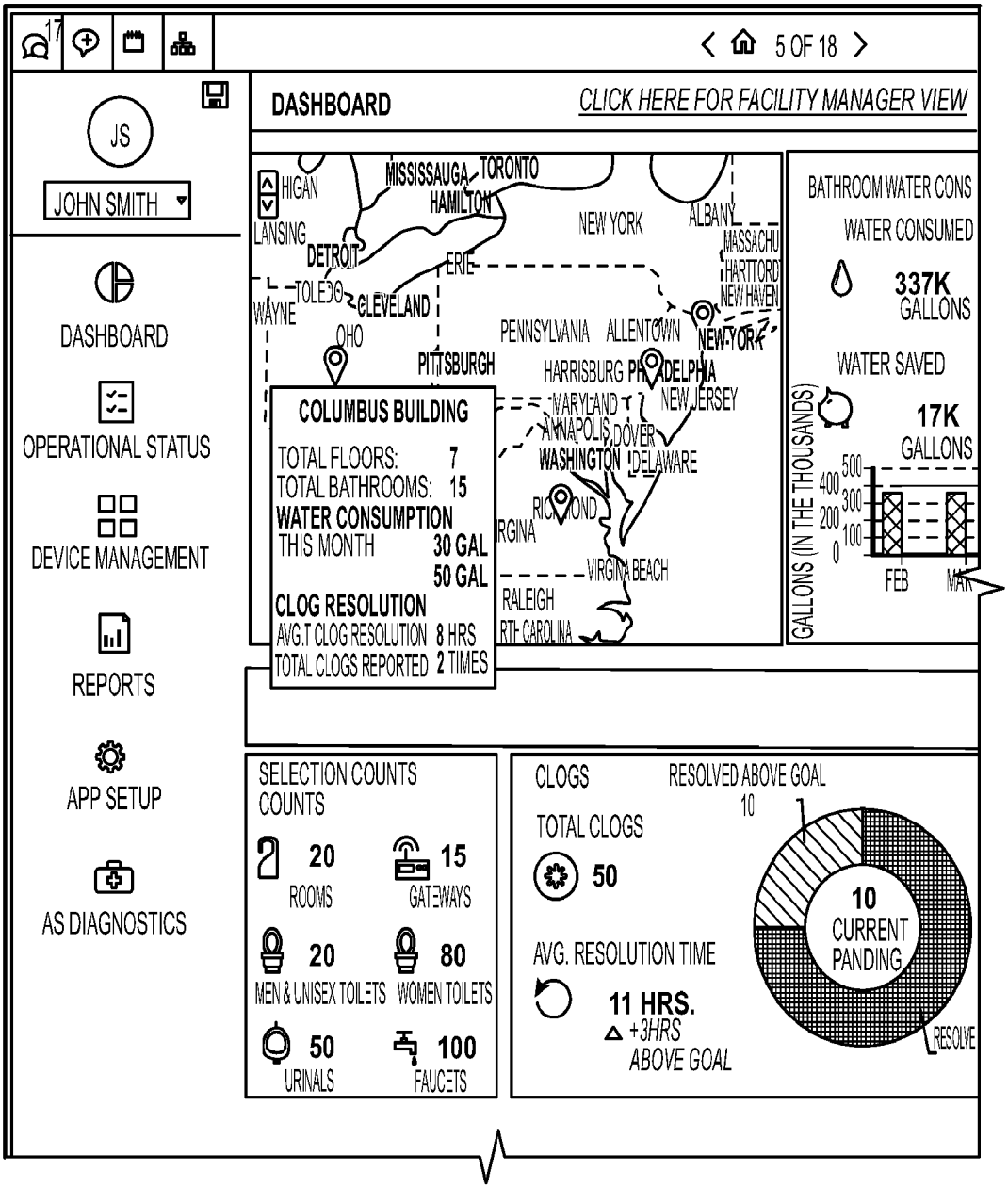
FIG. 3A, FIG. 3B, and FIG. 3C show a user side of a dashboard, according to some embodiments.
Figure 3A:
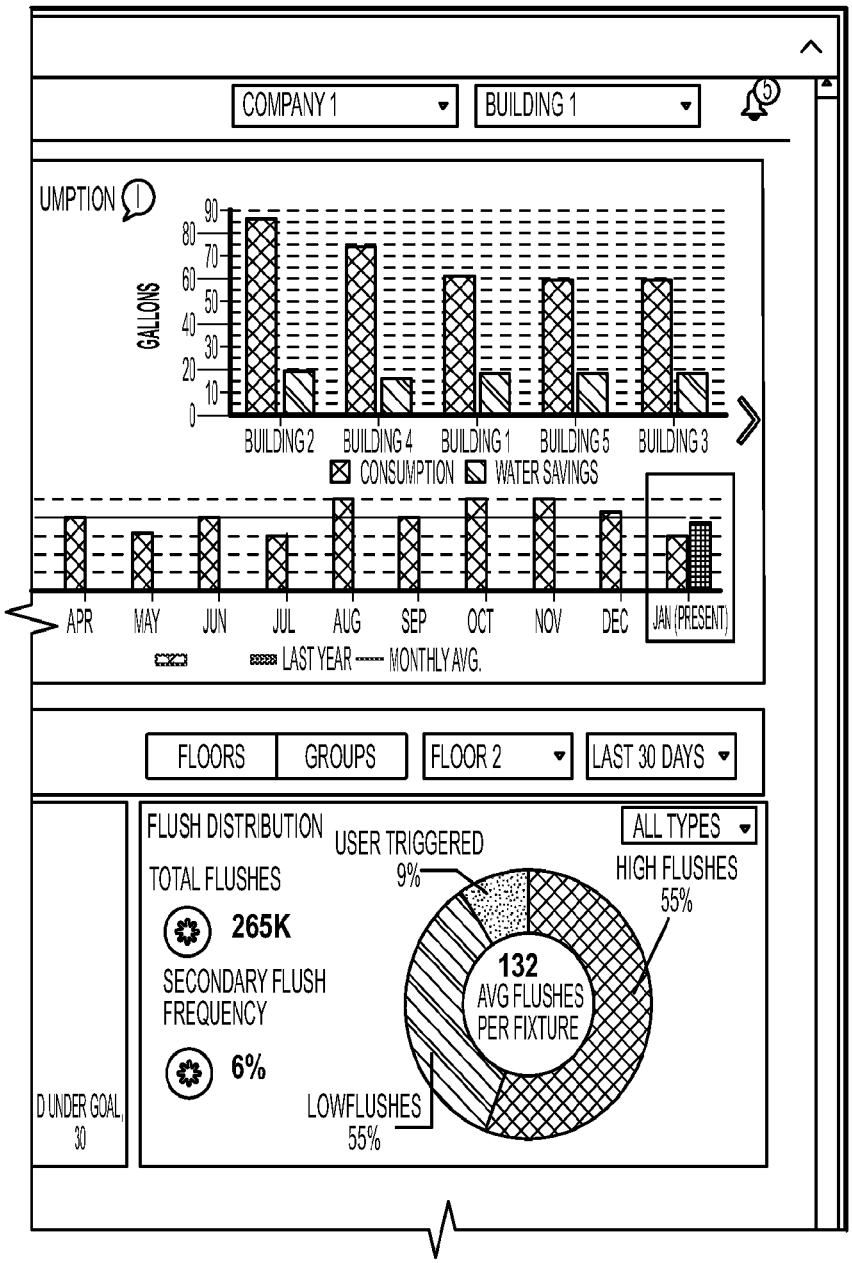
Figure 3A:
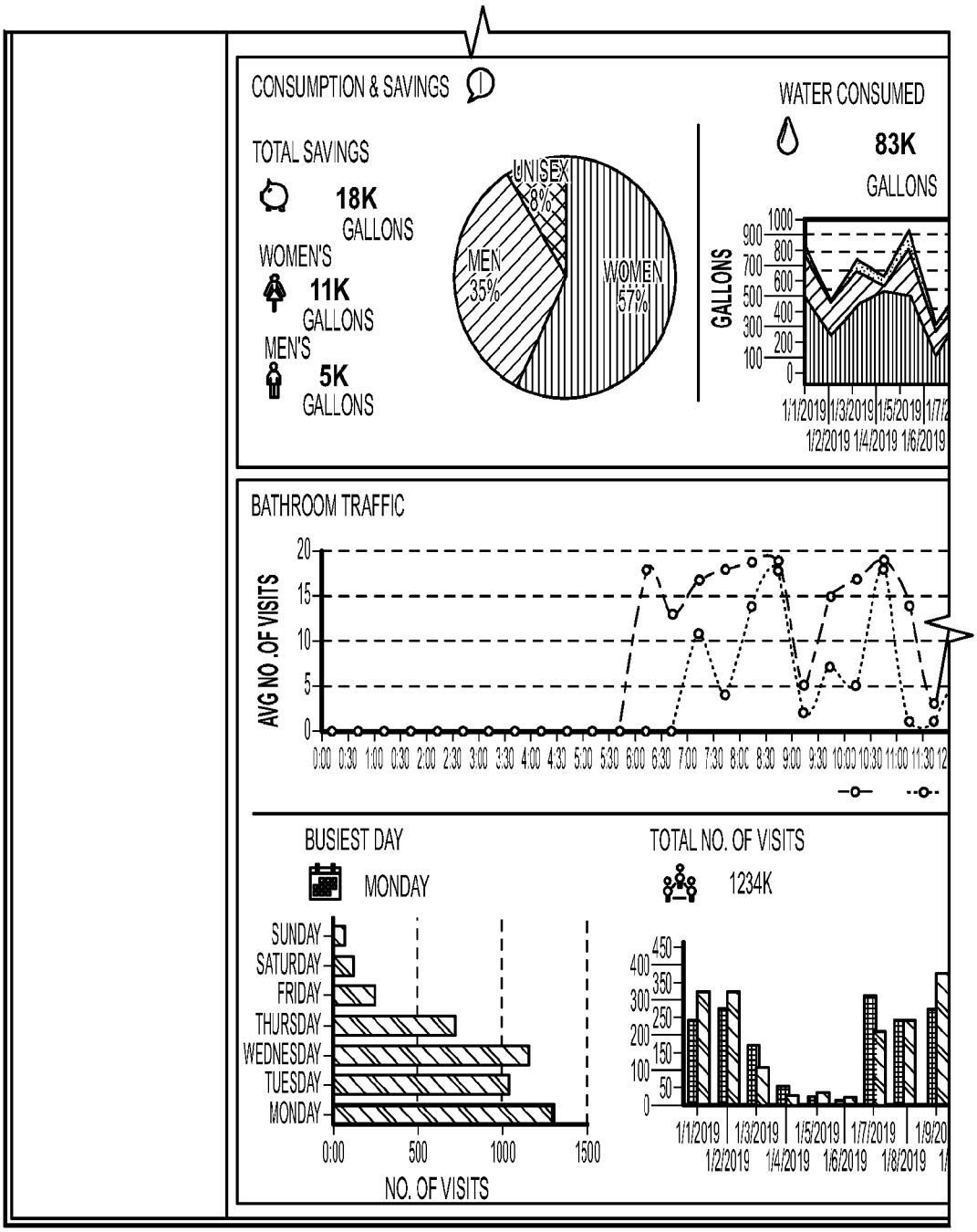
Figure 3A:
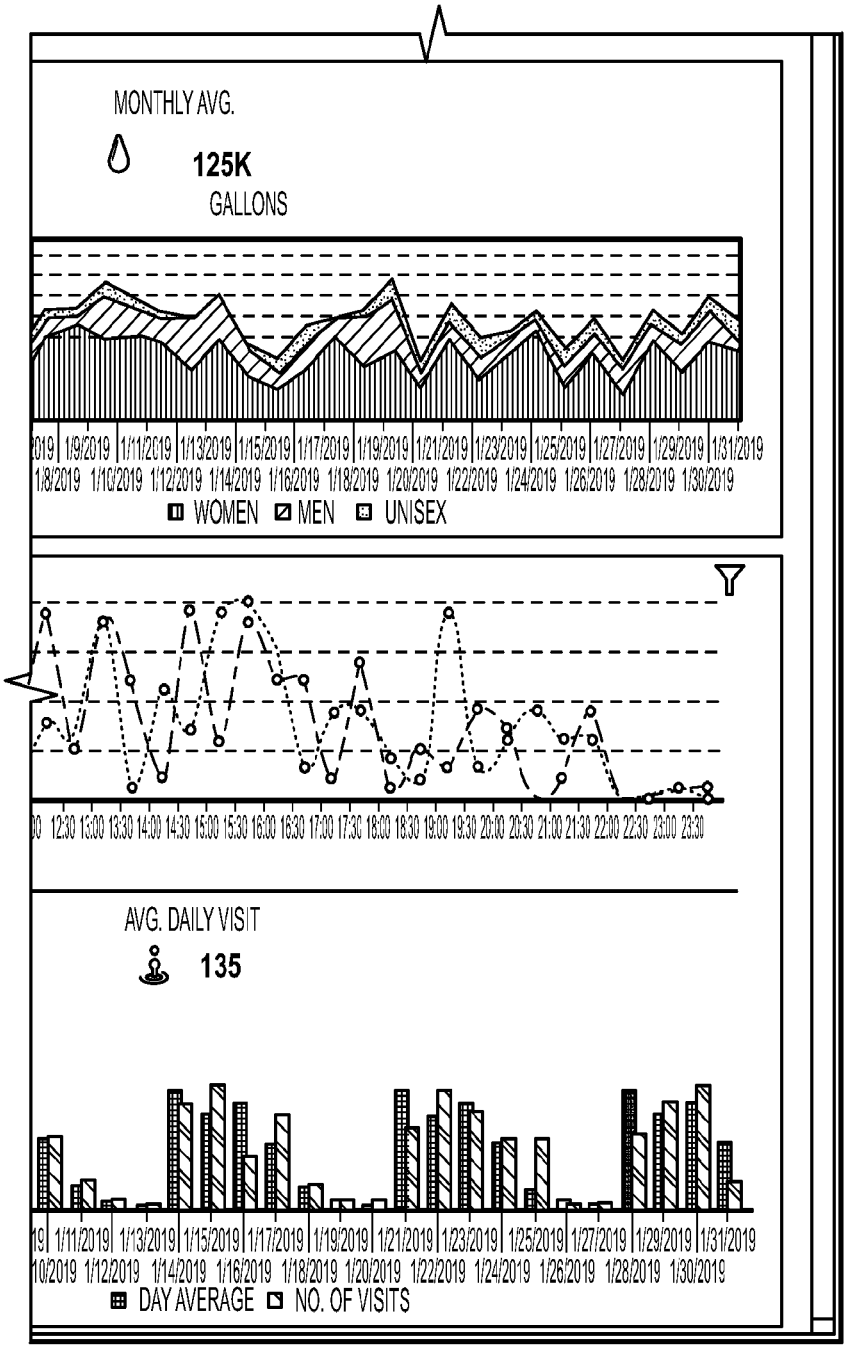

FIG. 3A depicts a user interface of dashboard 215, according to some embodiments. Dashboard 215 may be employed on a computing device, such as a laptop computer or a smartphone. Icons or modules may be visualized by a technician or analyst on dashboard 215 as shown. Dashboard 215 may include device status, alarms, alerts, communications, or combinations thereof, related to components of a connected system. For example, traffic volume, clogs, battery status, communication status, number of uses, water consumption, combinations thereof, etc., may be monitored and controlled with dashboard 215.

Figure 3B:
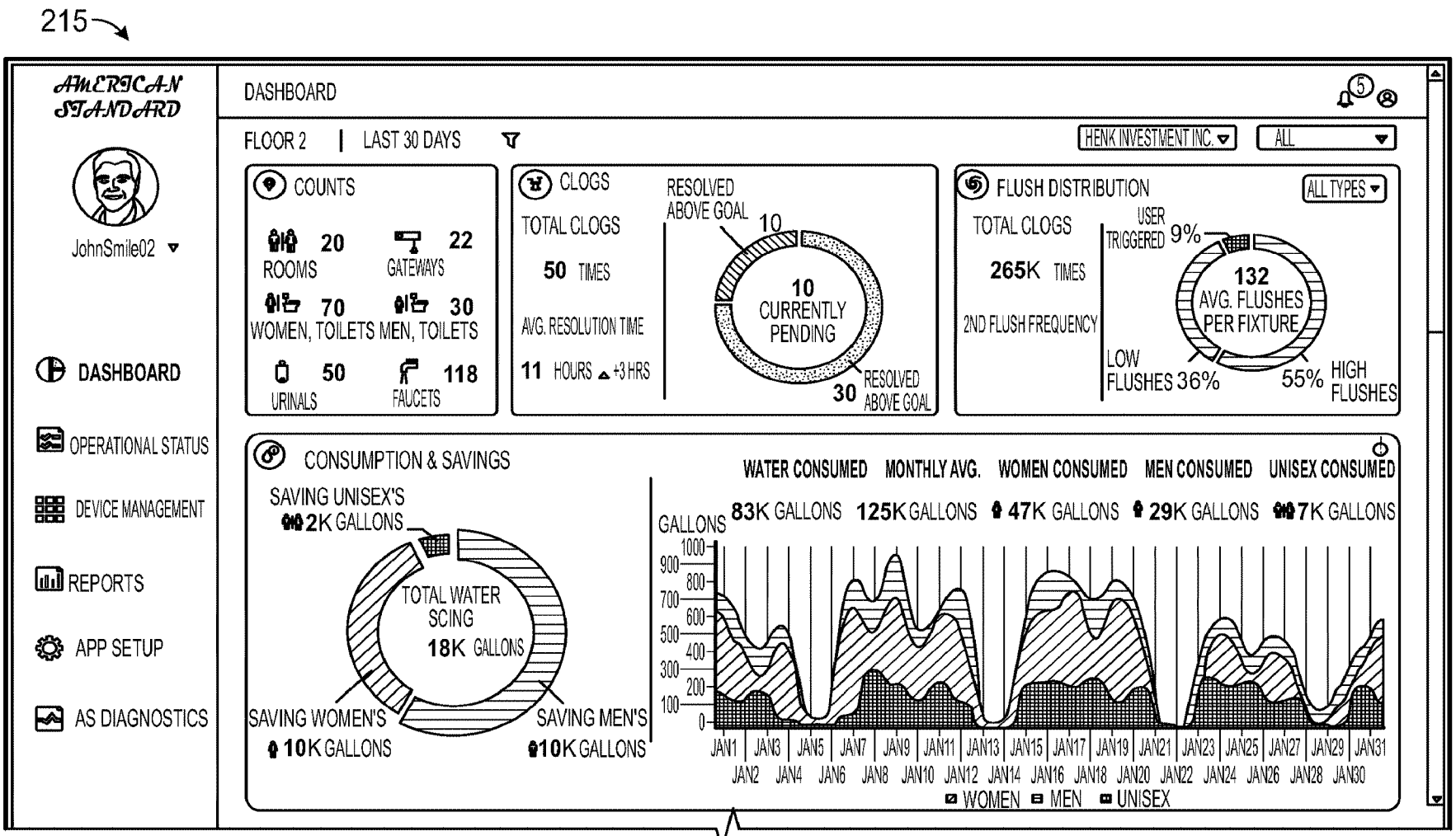
Figure 3B:
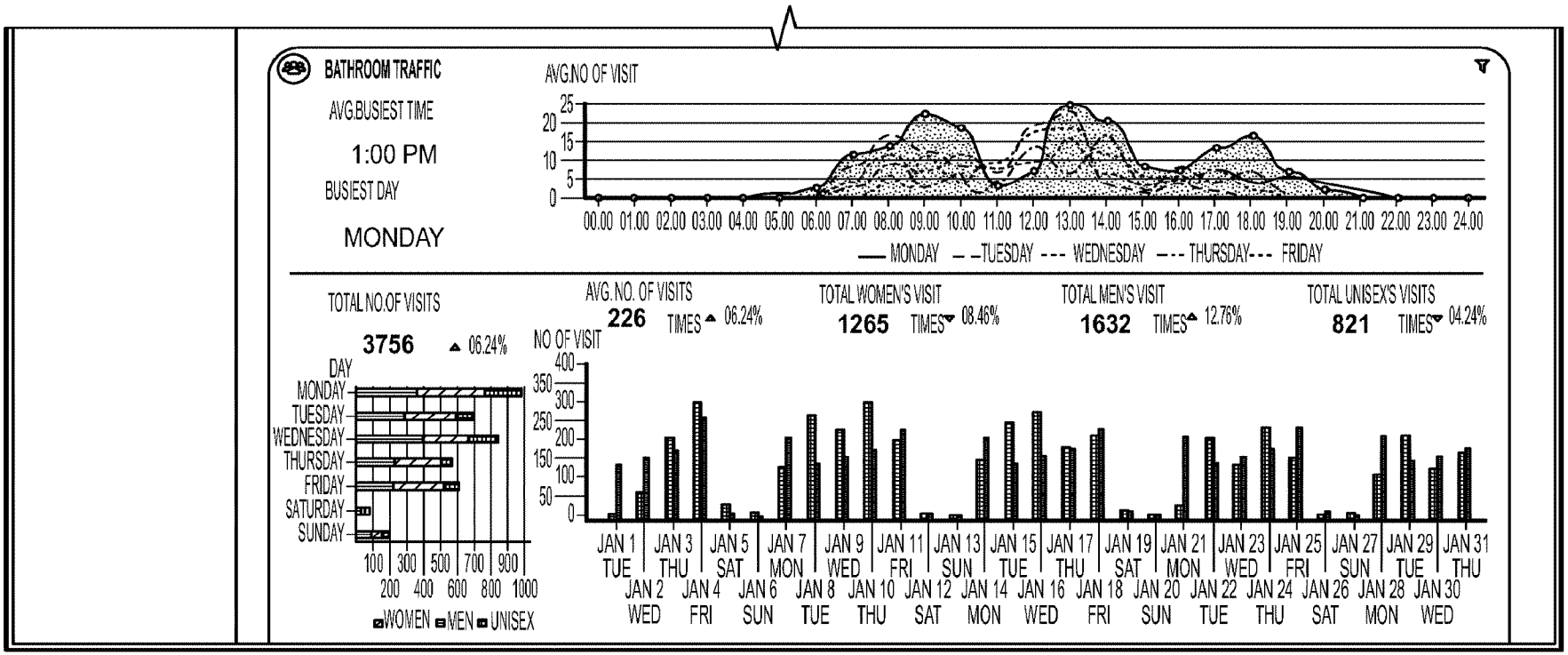
Figure 3C:
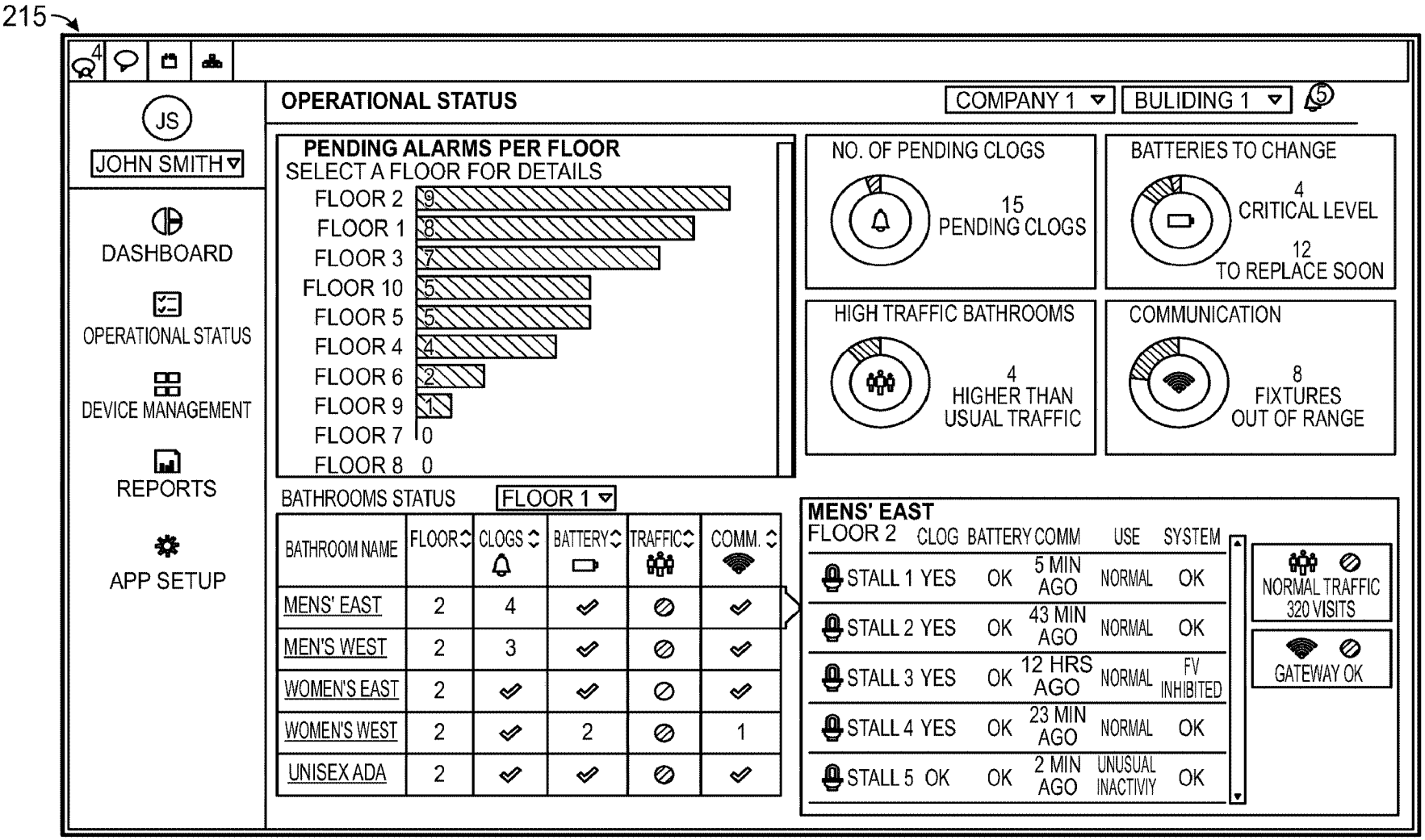

FIG. 3B and FIG. 3C provide a pictorial view of data that may be monitored, analyzed, and controlled in a connected system. Dashboard 215 may include filters to allow for visualization of any desired subset of devices and parameters based on a particular technician, building, campus, hall, etc. Views of dashboard 215 may show any data described herein. Data may include, for example, water consumption, water savings, total clogs, average resolution time, number of events per time period, bathroom traffic, etc. Data may be monitored, downloaded, visualized, processed, analyzed, or controlled based on a number of parameters. For example, data may be viewed per faucet, per bathroom, per building, etc.

Figure 4:
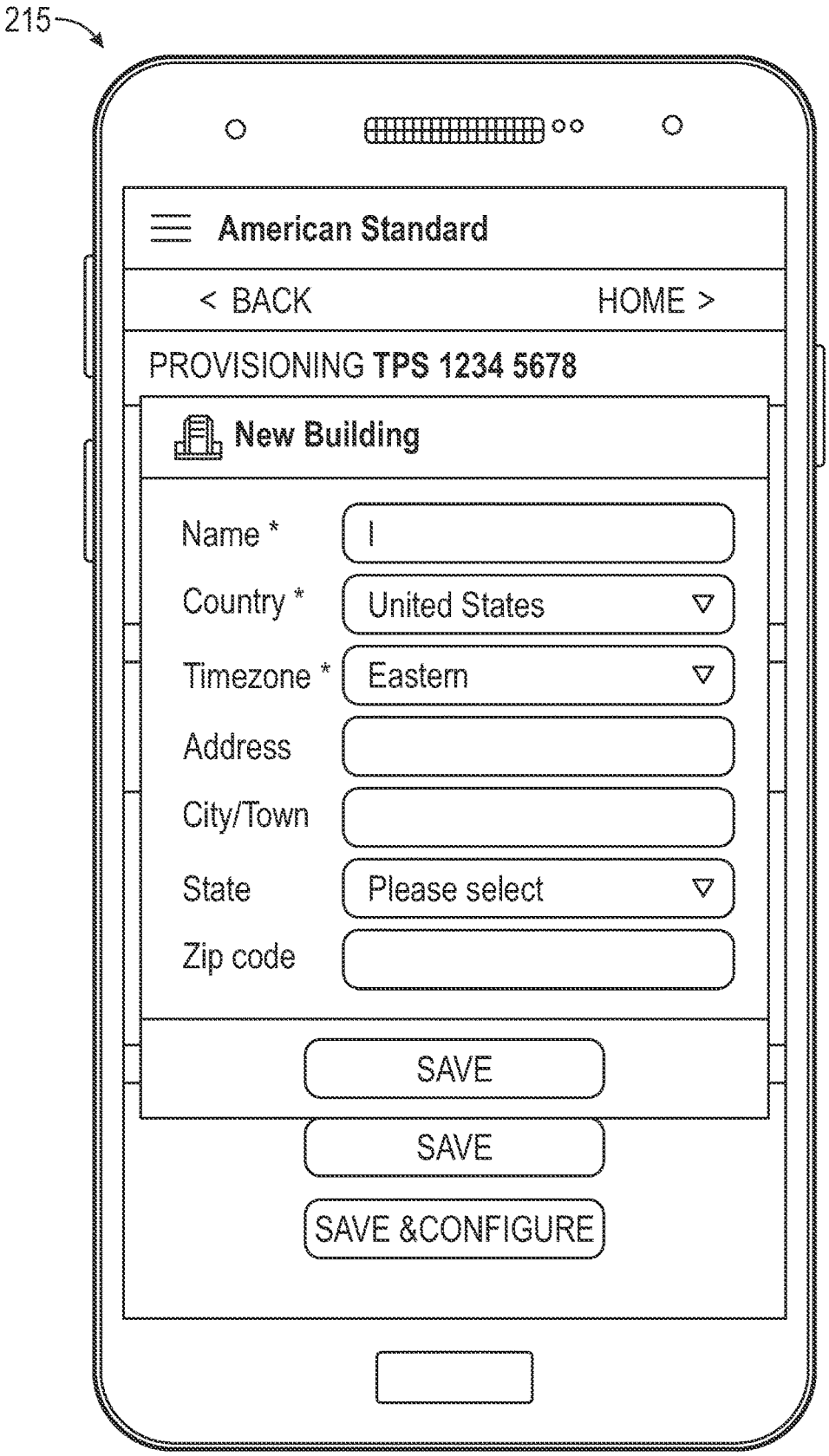
FIG. 4 shows a user side of a dashboard, according to an embodiment.

FIG. 4 shows dashboard 215 with set-up control of a connected system. Each component of a connected system, for example each faucet, sink, toilet, urinal, flush valve, paper dispenser, etc., may be separately entered into the system. This may allow for individual monitoring and/or control of each component from a hand-held computing device. Each building and floor may be assigned particular fixtures or devices within them. Although depicted as buildings or floors, parameters that may be assigned include rooms, wings, halls, etc. It is possible to monitor and control a subset of components of a connected system as selected by a technician or analyst.

Figure 5:
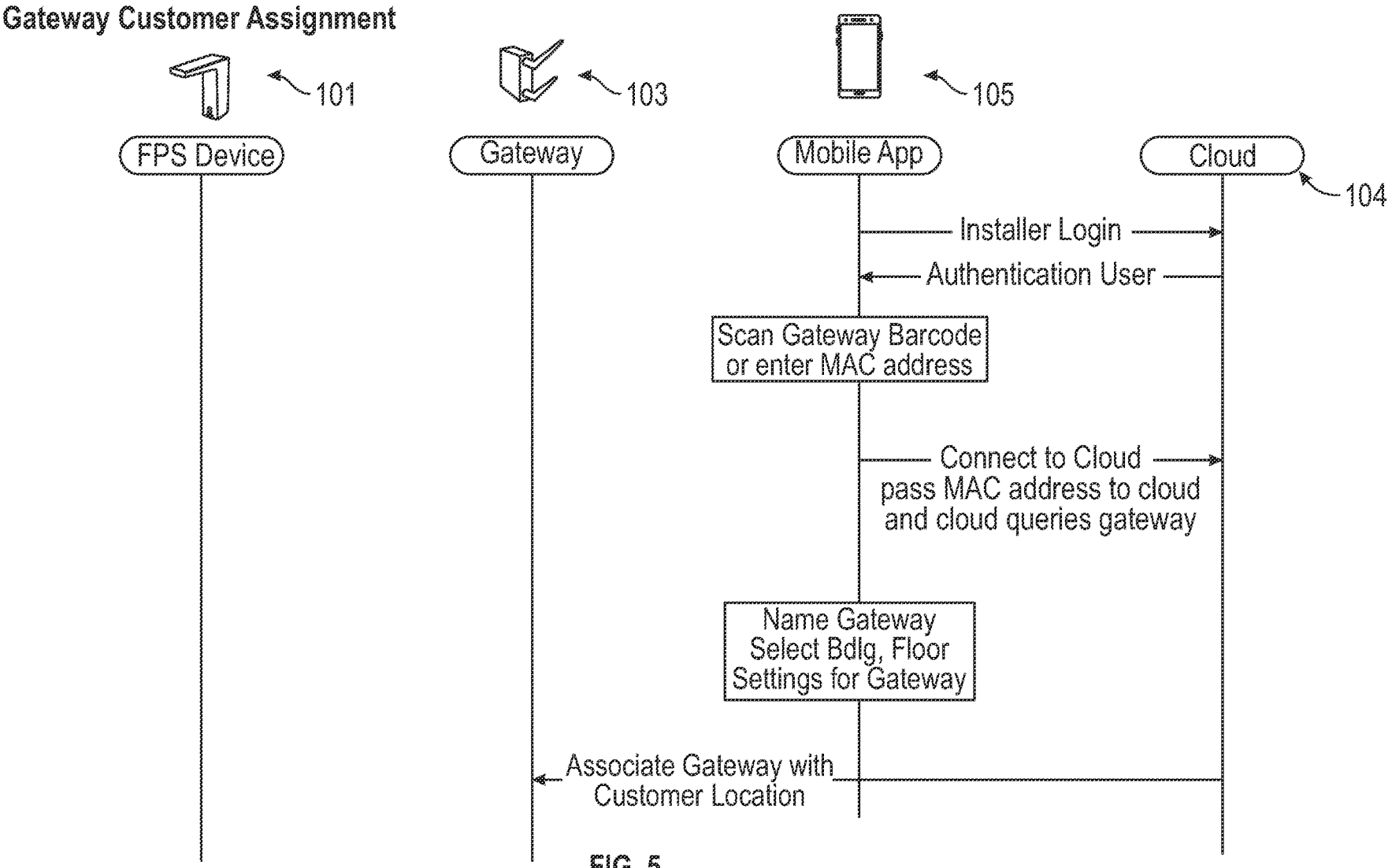
FIG. 5 illustrates a gateway customer assignment, according to an embodiment.

FIG. 5 shows a user (e.g. technician, analyst) gateway assignment for a connected system, according to an embodiment. Gateway 103 may be associated with a particular location by the user. The user may employ an application on computing device 105 to assign a gateway location and set up a connected system. A user may initiate log-in steps on a mobile application, server 104 may authenticate the user and allow the log-in to the mobile application on computing device 105. A user may scan or enter the address of gateway 103. Computing device 105 may communicate with server 104 and transmit the gateway address to server 104. A user may name and locate gateway 103. Server 104 may thus associate gateway 103 with a particular location within a user's connected system. For example, a user may have a gateway 103 for each room, floor, wing, building, or subset of faucet devices 101 that are intended to be monitored and controlled with a connected system. The term "FPS" refers to "Faucet Performance System". Server 104 may control a gateway assigned to a particular location based on information passed to and from a user by way of computing device 105.

Figure 6:
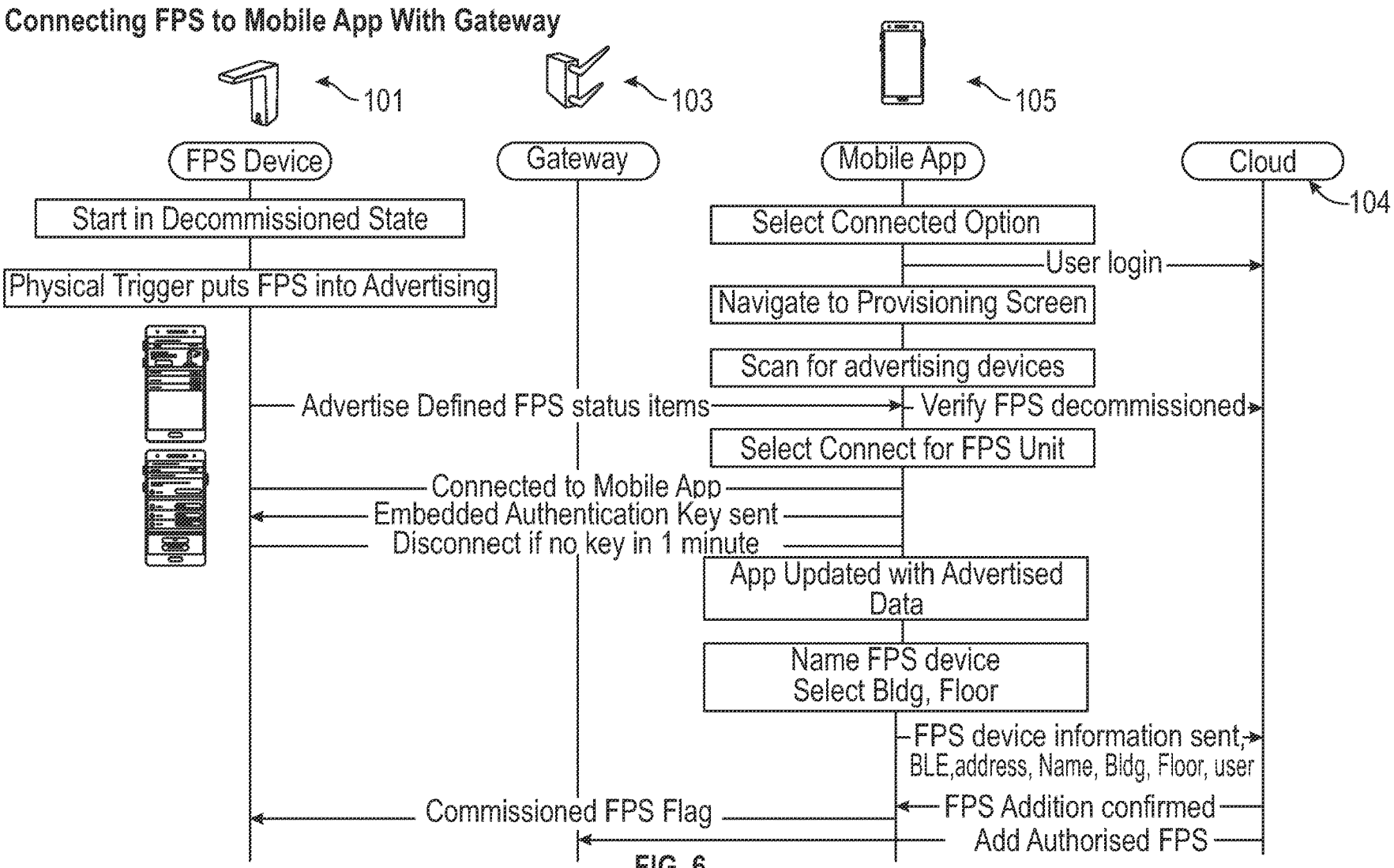
FIG. 6 shows an exemplary connection of a flush valve assembly to a computing device having a gateway, according to an embodiment.

FIG. 6 shows a faucet control system for a connected system with the use of a gateway, according to an embodiment. A faucet device 101 may be associated with a particular location by a user. A user may employ a computing device 105 (e.g., having a mobile application) to assign faucet 101 and set up a connected system. A user may initiate log-in steps on a mobile application, a server 104 may authenticate the user and allow the log-in to the mobile application on computing device 105. A user may scan or enter an address of device 101. Computing device 105 may communicate with server 104 and transmit an address of faucet 101 to server 104. A user may name and locate faucet 101. Server 104 may thus associate faucet 101 with a particular location within a user's connected system. That is, a user may have an address for each faucet in each of numerous rooms, floors, wings, or buildings that are intended to be monitored and controlled with a connected system. Communication between computing device 105 and the faucet 101 occurs by way of gateway 103 and server 104, as shown in FIG. 1A.

Figure 7:
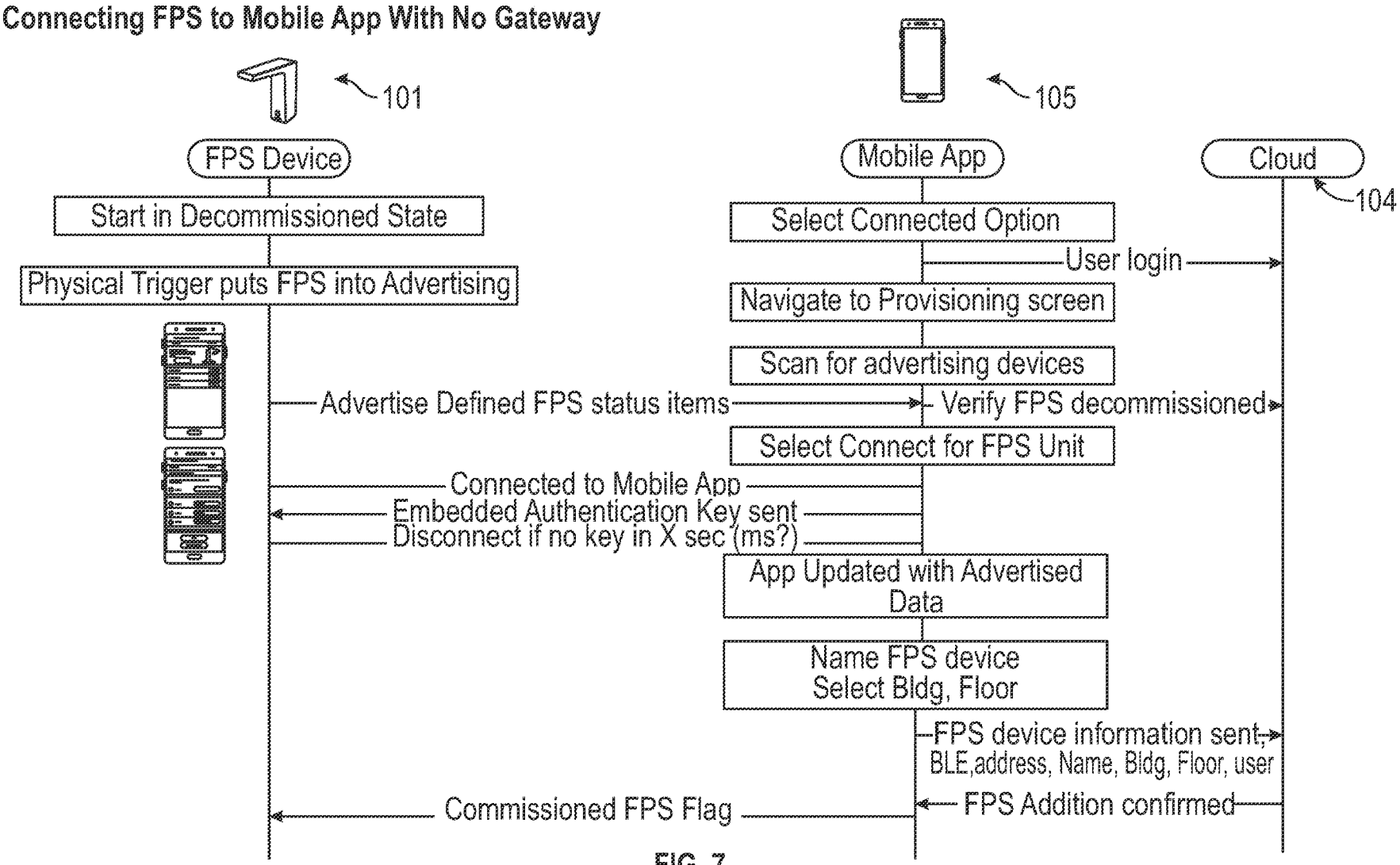
FIG. 7 shows an exemplary connection of a flush valve assembly to a computing device having no gateway, according to an embodiment.

FIG. 7 shows a faucet control system for a connected system without the use of a gateway, according to an embodiment. Faucet 101 may be associated with a particular location by a user. A user may employ computing device 105 (e.g. having a mobile application) to assign faucet 101 and set up the connected system. A user may initiate log-in steps on the mobile application, server 104 may authenticate the user and allow log-in to a mobile application on computing device 105. A user may scan or enter the address of faucet 101. Computing device 105 may communicate with server 104 and transmit an address of faucet 101 to server 104. A user may name and locate faucet 101. Server 104 may thus associate faucet 101 with a particular location within a user's connected system. That is, a user may have an identified location for each faucet 101 in each of numerous rooms, floors, wings, or buildings that are intended to be monitored and controlled with the connected system. Communication between computing device 105 and faucet 101 occurs without a gateway. Computing device 105 separately communicates with server 104. Faucet 101 does not directly communicate with server 104, as shown in FIG. 1B.

Figure 8:
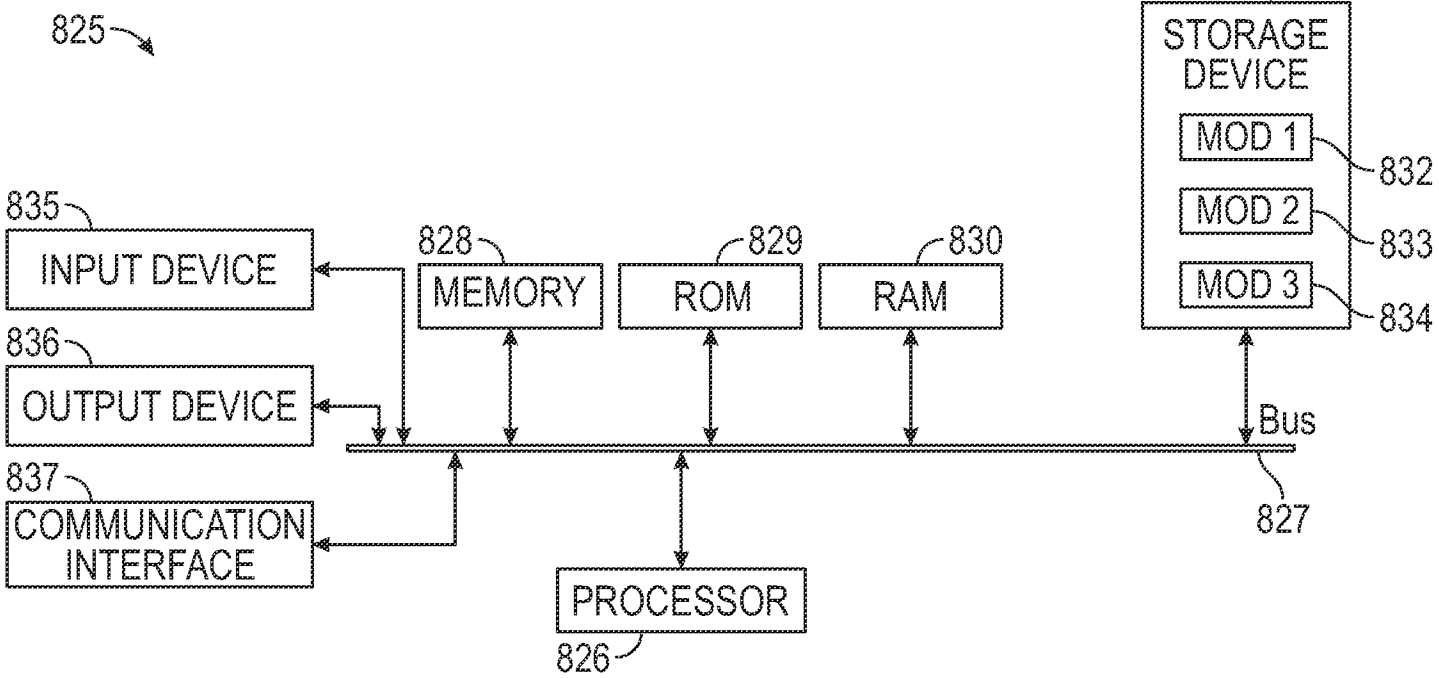
FIG. 8 illustrates a computing system, according to an embodiment.

FIG. 8 illustrates a computing system for use in a computing device 105, according to some embodiments. A general purpose computing system 825, includes processing unit (CPU or processor) 826 and system bus 827 that may couple various system components including a system memory 828 to processor 826. System memory 828 may be a read-only memory (ROM) 829 and/or a random access memory (RAM) 830. Computing system 825 may include a cache of high-speed memory connected directly with, in close proximity to, and/or integrated as part of processor 826. Computing system 825 may copy data from memory 828 and/or storage device 831 to a cache for quick access by processor 826. In this way, a cache may provide a performance boost that avoids processor delays while waiting for data. These and other modules may control or be configured to control processor 826 to perform various actions. Other system memory 828 may be available for use as well. Memory 828 may include multiple different types of memory with different performance characteristics. System 825 may operate with more than one processor 826 or with a group or cluster of computing devices networked together to provide greater processing capability. Processor 826 may include any general purpose processor and a hardware module or software module, such as MOD1 832, MOD2 833, and MOD3 834 stored in storage device 831, configured to control processor 826 as well as a special-purpose processor where software instructions are incorporated into the actual processor design. Processor 826 may essentially be a completely self-contained computing system, containing multiple cores or processors, a bus, memory controller, cache, etc. A multi-core processor may be symmetric or asymmetric.

Bus 827 may be any of several types of bus structures including a memory bus or memory controller, a peripheral bus, and a local bus using any of a variety of bus architectures. A basic input/output (BIOS) stored in ROM 829 or the like, may provide the basic routine that helps to transfer information between elements within system 825, such as during start-up. System 825 further includes storage devices 831 such as a hard disk drive, a magnetic disk drive, an optical disk drive, tape drive or the like. Storage device 831 may include software modules 832, 833, 834 for controlling processor 826. Other hardware or software modules are contemplated. Storage device 831 is connected to system bus 827 by a drive interface. The drives and the associated computer-readable storage media provide nonvolatile storage of computer-readable instructions, data structures, program modules and other data for system 825. In one aspect, a hardware module that performs a particular function includes a software component stored in a tangible computer-readable storage medium in connection with the necessary hardware components, such as processor 826, bus 827, display 836, and so forth, to carry out a function. In another aspect, a system can use a processor and computer-readable storage medium to store instructions which, when executed by the processor, cause the processor to perform a method or other specific actions. The basic components and appropriate variations are contemplated depending on the type of device, such as whether the device is a small, handheld computing device, a desktop computer, or a computer server.

Although the exemplary embodiment described herein employs a hard disk for storage device 831, other types of computer-readable media which can store data that are accessible by a computer, such as magnetic cassettes, flash memory cards, digital versatile disks, cartridges, random access memories (RAMs) 830, and read-only memory (ROM) 829, may also be used in an exemplary operating environment.

To enable user interaction with system 825, an input device 825 represents any number of input mechanisms, such as a microphone for speech, a touch-sensitive screen for gesture or graphical input, keyboard, mouse, motion input, speech and so forth. An output device or display 836 can also be one or more of a number of output mechanisms known to those of skill in the art. In some instances, multimodal systems enable a user to provide multiple types of input to communicate with system 825. Communications interlace 837 generally governs and manages user input and system output. There is no restriction on operating on any particular hardware arrangement and therefore the basic features here may easily be substituted for improved hardware or firmware arrangements as they are developed.

A phrase "faucets are configured to communicate with . . . " may mean a controller associated with a faucet is configured to electrically communicate with, for example a computing device or a gateway.

In some embodiments, the disclosure relates to systems and methods for monitoring and control of a set or collection of devices in one or more bathrooms within a building or buildings, warehouse, campus, etc. For example, the systems and methods may monitor and control toilets, urinals, faucets, and/or paper dispensers (e.g., paper towel or toilet paper) within one or more restrooms in a building, buildings, warehouse, campus, etc. Control and monitoring may be facilitated by electrically coupling (either wireless, wired, or a combination thereof) various devices to each other and/or to a computing device. Thus, a technician may monitor a status of each device remotely from a computing device. When a problem or other activity occurs in a monitored device, a technician may initiate a response or action via the computing device. For example, if a slow drain is detected in a sink associated with a faucet, a technician may disable the use of that faucet and/or other faucets in fluid communication with the clogged sink. In some embodiments, an action may be initiated automatically based on programmed instructions, data stored in a central cloud/server, and/or data stored on a computing device. In this manner, a technician may have remote control of a collection of bathrooms within a single location (e.g., via a computing device). This may facilitate maintenance, control, and monitoring of bathrooms and/or may assist in water conservation and/or a reduction in water usage in a collection of bathrooms.

In some embodiments, a system may include connected, interconnected and/or networked faucets and/or sinks. The disclosure also relates to a system that may include one or more sanitaryware fixtures, such as toilets, urinals, or bidets. Each of the one or more faucets or sinks may include one or more sensors and/or flow meters to determine a status or condition of an individual system or an individual faucet or sink in the system, and perform a particular function or action. A system may automatically perform a function (e.g. open a valve, close a valve and/or angle stop, send an alert, initiate a service ticket, etc.). A system may communicate a status or condition to an internet connected computing device, whereupon the device may then perform the function or may instruct a faucet to perform the function. For example, die device may instruct a valve opening, a valve closing, or initiation of a service ticket. A computing device may log and monitor a status or condition of the sanitaryware to improve the overall efficiency and operation of a faucet and a collection of faucets.

In some embodiments, systems and methods in accordance with the principles of the invention include communication and an ability to communicate. Systems may include a faucet capable of communicating with one or more devices. One or more devices may be internet connected devices. In one aspect, devices are connected to each other in order to transfer data, information, instructions, inputs, and outputs. Network connections may include bridges, routers, switches and gateways. The one or more devices may be capable of one-way, two-way and/or multi-way communication with faucets, as will be described in more detail to follow. For example, the one or more devices may be other faucet devices, sanitaryware devices, mobile devices, computers, other plumbing fixtures, etc.

One or more sensors may send and/or receive signals from the one or more devices. The one or more devices may be external devices (e.g. a centralized data server, a computer, tablet, mobile device, other plumbing fixtures, etc.) or internal, faucets, sinks, sanitaryware devices, flush valves, angle stops, other valves, etc.). The one or more devices may be external to the particular faucet in which the sensor is located or internal to the faucet. The one or more sensors may communicate directly with the one or more devices. That is, one or more sensors may send a signal corresponding to a sensed one or more parameters of a faucet or sink to the one or more devices. The one or more devices may evaluate the data and determine a status or condition of the faucet or sink. The one or more devices may send a signal indicative of the status or condition of the sanitaryware to a user for evaluation or action. The action may include repair, replacement, or cleaning, for example, of the faucet or sink.

One or more sensors may communicate with a control system and/or communication system. A control system may include one or more controllers and/or one or more computer devices. A control system may communicate directly with one or more devices, as will be described in more detail to follow. One or more sensors may send a signal corresponding to a sensed one or more parameters of a faucet or a sink to the system. The control system may determine a status or condition of a faucet or sink based on the sensed data and algorithms present in the system. The control system may instruct one or more faucet to perform a function, such as, for example, dispensing a particular water volume, shutting of flow of water to the faucet (e.g. closing an angle stop), may initiate a service ticket (e.g. via a central computer system or mobile device, etc.). A computing device or cloud/server may log a status and function performed. Data collected by a computing device and/or cloud/server may be used to improve efficiency of a building system or network of faucets.

In some embodiments, a control system may determine, based on collected data, that a certain dispensed faucet water volume leads to a high number of second uses, and based on that determination the control system increases the water volume for one or more faucets, leading to overall water conservation. In an example, a control system may increase water volume for all connected faucets or for a subset of faucets. A subset may be faucets in a same room, building, or vicinity of the identified faucets. In an example, efficiency of a building system may be improved based on analysis of collected data by modifying water usage for one or more related faucets which are located remotely from a faucet at which the data was collected. In another example, a control system may determine, based on collected data, that a certain dispensed water volume is more than required based on detection of a presence/absence of a user. In such a situation, a control system may instruct a faucet or faucets to reduce water volume. Presence/absence of a user may be determined via signals generated from a presence sensor.

Data received from a plumbing device may be analyzed (e.g., regression analysis, Monte Carlo simulation, averages, etc.), and based on the analysis water usage at a particular device may be modified. Data from more than one device may be aggregated and combined together for analysis, and as additional data is generated by the devices, that data may be added to the previously collected data and analyzed. In an example, if a data storage limit is present, the system may replace the oldest data saved with new, updated, or more recent data. Data may be collected in any number of ways. Collection and/or analysis of data may occur on a predetermined basis. In an example, analysis of data may occur on a periodic basis (e.g., every hour, every day, every week, etc.) or, may occur as data is received and combined with previous data.

Faucets and/or sinks may be coupled to one or more internet connected devices (e.g. internet-of-things or IoT devices). Devices may include a computer, a tablet, phone, mobile device, components of fixtures or fittings (e.g. valves, sensors, etc.), appliances, and/or fixtures within a building (e.g. a sink, shower, bathtub, faucet, toilet paper dispenser, paper towel dispenser, soap dispenser, other sanitaryware, toilet, urinal, bidet, refrigerator, freezer, dishwasher, drinking fountains, water features, etc.). IoT devices may have two-way communication such that the faucets, sinks and/or IoT devices may each send and receive signals, instructions, data, etc. Signals may be associated with a function of a faucet and/or IoT device. Two-way communication may be wired, wireless, PAN, Bluetooth® (e.g. short-range wireless communication), other low power wireless, short range communication, or combinations thereof. For example, a faucet or sink may communicate a status (e.g. leak, slow drain, cleaning cycle, dispensing, water volume, dispensing time, etc.) to an IoT device. A status of a faucet or sink may be determined in accordance with the communication. An IoT device may evaluate a status of a faucet or sink, compare it to a database of predetermined instructions, and send a corresponding instruction back to the faucet or to a component coupled to the faucet. Alternatively or additionally, an IoT device may evaluate a status of a faucet or sink and communicate predetermined instructions to a third IoT device. For example, an IoT device may send instructions to a shut-off valve or angle stop valve associated with a faucet to open or close, thus opening or closing the water flow to the faucet.

Components of a connected system may be in electrical communication (e.g., connectivity) with each other. That is, components or devices of a connected system may be in electrical communication with other components or devices, such as sensors, controllers, computing devices, internet devices, a central cloud/server, sanitaryware devices (or the other devices described herein) etc. Electrical communication may allow for transmission to and/or from each component or device. Electrical communication may include transmission of data, information, instructions, status, etc., or combinations thereof. Electrical communication may be one-way, two-way, and/or multi-way communication. Such communication can occur via half-duplex or full-duplex. Electrical communication may be between faucets, sinks, parts, power sources, flush valves, toilets, urinals, IoT devices, etc. Electrical communication may be wired and/or wireless. Electrical communication may be through a gateway. Electrical communication may include transmission of electrical signals that include data, information, instructions, etc., or combinations thereof.

In an embodiment, a control system may be programmed with an algorithm to determine an optimal faucet water dispensing volume and/or time. An algorithm may take into account a duration threshold of a presence sensor, a duration of the presence sensor, and/or a sensed water volume or time reading. Water volume may communicated from a flow meter to a controller and water dispensing time may be measured and communicated by a controller. In some embodiments, stored information on a history of a faucet at a particular time of day, or in a particular location, or other stored information may be used to instruct a faucet to dispense a certain volume of water and/or for a certain time period. A system may provide water faucet water savings by for example reducing a number of second (repeat) activations by a single user, or by not allowing water flow after a user has left a faucet. In some embodiments, a flow meter may comprise a pressure sensor, a Hall Effect sensor, a turbine sensor, a propeller sensor, or an ultrasonic sensor.

A particular water use event, or faucet or sink status indicated may be communicated to a device (e.g. a cloud/server) to log and/or monitor operation of the faucet. Information that is logged may be used for a variety of purposes, for example, for budget planning, LEED validation, tenant marketing, return on investment, future investment, and/or management of consumable products (e.g. cleaning fluids, detergents, deodorizers, toilet paper, etc.). Information may be used to monitor faucet use habits or activities and the metrics of the same of a user. This may be helpful in hospitals, where patient faucet activities and metrics of the same may be monitored and logged for health care purposes. Information may be used for influence of code agencies with data. Information may be used to monitor water usage of a faucet or collection of faucets and thus monitor water usage of all faucets in a building. This may allow for potential of water savings based billing. Information may be used for customer marketing. Information may be used to control a same faucet at a future time and/or to control another faucet or collection of faucets.

Monitoring and logging of dispensed water volume and dispensed water flow time initiated with each use of a faucet, may improve overall efficiencies of a faucet or collection of faucets. Tracking may allow a water supply to a building or buildings be carefully managed and use of the water supply may be maximized. For example, a building may be able to account for higher usage of a water supply to a building at certain times of day, based on data logged from a faucet or collection of faucets. At these times, a control system may communicate with other devices (e.g. other plumbing fixtures or fittings or devices controlling other plumbing fixtures or fittings) to reduce the water supplied to these devices during this time period. Thus, as described, monitoring data may improve efficiencies of a faucet or faucet system by conserving water through a faucet, collection of faucets, a building, or collection of buildings.

An ability of faucet system to determine a leak event and take appropriate action (e.g. closing an angle stop valve and/or shutting off water flow to a faucet or collection of faucets) may have disaster prevention advantages, may allow for higher availability and/or lower downtime of a faucet system, may allow for a cleaner restroom, and may improve client satisfaction. In some embodiments, a faucet may be associated with a flow meter. For example, a faucet may have a flow meter associated with a cold water source, or may have a flow meter associated with both a cold water source and a hot water source. In some embodiments, a control system is configured to monitor a flow meter after a faucet has been used and a solenoid valve has been moved from an open position to a closed position, and to recognize a leak event if a flow meter indicates water flow above a predetermined threshold value. In some embodiments, a threshold value may be about 0.5 liters/min or about 0.6 liters/min. In some embodiments, water flow at or above a threshold valve is sensed after a safety timer has elapsed after faucet use.

A control system may initiate a task request or service ticket to a technician or analyst to repair or replace a faucet. A control system may send instructions to an angle stop to shut source water flow to a faucet until it can be serviced. This will provide for water savings and prevent damage to a bathroom or building. A faucet status may be communicated to a computing device and/or cloud/server to log and/or to monitor. Information may be used to monitor overall health of a building by location and over time (e.g. over the life of a faucet or collection of faucets). Information may be used to monitor trends (e.g. trends in leaks), poor plumbing, and/or vandalism, etc. Information may be used to monitor building plumbing health by age, type, location, and/or time. Monitoring and logging of leak events may improve the overall efficiencies of a system. Tracking may allow a collection of faucets within a building and the water supply of the building to be carefully managed. For example, monitoring a number of times leak events occur may allow for preventative maintenance or early diagnosis of a failure. A system may also communicate with other faucets or faucet systems to allow for compensation for out of service faucets. Furthermore, it may allow technicians and/or janitors to improve efficiencies in managing plumbing fixtures and fittings in a building. Knowing (the time, location, and severity of a leak may allow for a technician and/or plumber to arrive properly prepared to address the problem. A location of leaks or malfunctioning faucets may be mapped for a technician and/or janitor. This may also allow a technician and/or plumber to address more than one problem faucet at a single time.

According to some embodiments, a sink associated with a faucet may be associated with a sensor to determine a clogged or slow drain. In some embodiments, a sensor may comprise an ultrasonic sensor or a capacitive sensor. In some embodiments, a sensor may be positioned on a sink underside, or on a sink trapway. An ability of a faucet system to determine a clogged or slow sink drain and take appropriate action (e.g. closing an angle stop valve and/or shutting off water flow to a faucet or collection of faucets) may have disaster prevention advantages, may allow for higher availability and/or lower downtime of a faucet system, may allow for a cleaner restroom, and may improve client satisfaction. In some embodiments, a drain sensor may be in wired or wireless communication with a controller associated with a faucet.

A control system may initiate a task request or service ticket or send an e-mail to a technician or analyst to repair or replace a clogged trapway. A control system may send instructions to an angle stop to shut source water flow to a faucet until a sink can be serviced. This may prevent damage to a bathroom or building. A sink status may be communicated to a computing device and/or cloud/server to log and/or to monitor. Information may be used to monitor overall health of a building by location and over time (e.g. over the life of a sink or collection of sinks). Information may be used to monitor trends (e.g. trends in clogs/slow drains), poor plumbing, and/or vandalism, etc. Information may be used to monitor building plumbing health by age, type, location, and/or time. Monitoring and logging of clog or slow drain events may improve the overall efficiencies of a system. Tracking may allow a collection of sinks within a building and the water supply of the building to be carefully managed. For example, monitoring a number of times clogs or slow drain events occur may allow for preventative maintenance or early diagnosis of a failure. A system may also communicate with other faucets or faucet systems to allow for compensation for out of service faucets. Furthermore, it may allow technicians and/or janitors to improve efficiencies in managing plumbing fixtures and fittings in a building. Knowing (the time, location, and severity of a clog may allow for a technician and/or plumber to arrive properly prepared to address the problem. A location of clogs or slow drains may be mapped for a technician and/or janitor. This may also allow a technician and/or plumber to address more than one problem faucet at a single time.

In some embodiments, an angle stop may be in wired or wireless communication with a controller, and the controller may be configured to send instructions to an angle stop to close upon indication and determination of a leak event or a clog/slow drain event. A technician may be able to send instructions from a computing device to re-open an angle stop upon completion of a repair.

In some embodiments, a control system may be able to monitor battery status and may allow for initiation of a service ticket, inventory management, service planning, proactive repair and/or battery replacement, monitoring of battery life versus other trends, etc. A battery status may be communicated to a computing device and/or cloud/server to log and analyze. For example, monitoring of a battery status may allow for preemptive recharging or replacement of batteries to avoid or prevent functions of a faucet from being inoperable due to an inoperable battery. Thus, monitoring and logging of the battery status may improve the overall efficiencies of a system. Electric power may be delivered via a battery and/or a building power supply.

In some embodiments, if a battery drops below a threshold, for instance about 5.6V, a computer device and/or a cloud server may issue an alert to notify a technician or analyst, allowing time to replace and/or recharge the battery. In some embodiments, if a battery power drops below a lower threshold, for instance about 5.4V, a control system may be configured to "shut off" a faucet or collection of faucets, for instance directing a solenoid to remain closed, as well as to alert a technician or analyst.

In some embodiments, a control system may be configured to monitor water pressure and may provide for adjusting a water dispensing time based on pressure, thus allowing for water savings. A cold water source line or both a cold water source line and a hot water source line upstream of a faucet or a collection of faucets may comprise a flow meter or pressure sensor. A control system may adjust water dispensing time in response to water pressure being above or below a predetermined level or range, in order to ensure dispensing a consistent volume of water per use. A dispensing time relates to a time a faucet solenoid valve is in an open position. In some embodiments, a control system may be configured to adjust a position of an angle stop upstream of a faucet or a collection of faucets in response to a measured water pressure. Predetermined water pressure levels or ranges may be programmed in a control system, and may be updated based on historical data of a faucet, a faucet system, or other faucet systems. Accordingly, a faucet or a collection of faucets may maintain a desired water pressure as a control system may respond to a monitored or sensed change in water pressure.

Water pressure may be communicated to a computing device and/or a cloud/server to log and/or monitor operation of a faucet system and may be logged for a variety of purposes. For example, information may be used to initiate a service ticket and/or send an e-mail to a technician. Information may be used to facilitate troubleshooting (e.g. cost savings, less lime diagnosing issues, fixing issues with one visit, bringing the right parts and tools for repair, sending requests to a correct department or individual). Information may be used for trends (e.g. building plumbing health by age, type, location, time, sanitation system, etc.). Monitoring and logging of water pressure may improve the overall efficiencies of a system.

In some embodiments, a control system may be configured to monitor faucet use, and may allow for an ability to determine faucet availability, metering, real-time bathroom availability by location, and efficient building design. Faucet use may be communicated to a computing device and/or cloud/server to log and/or monitor the operation thereof. For example, information may be used to monitor how, when, and how frequently a bathroom, a faucet, or other bathroom fixtures are being used. Information may be used to determine trends in bathroom usage. Information may be used to determine a frequency and level of cleaning and maintenance. Predictive analytics in combination with sensor information and information from surrounding devices may be used to determine a use frequency of a faucet device (e.g., if the frequency of use is too low or too high). For example, a controller may determine a condition is an uncharacteristically high or low use level of a faucet compared to historical data or to historical data of another faucet or faucet system. Information may be used to determine service planning, monitoring how restrooms are utilized by building type, and develop bathroom availability messaging. Thus, monitoring and logging of faucet use may improve overall efficiencies of a system.

In some embodiments, a control system may be configured to count a number of activations (faucet on/off events) and to recommend proactive/predictive maintenance that may be required based on the number of activations. For example, certain components, such as a piston assembly or solenoid may require replacement or maintenance after a certain number of activations. In some embodiments, a control system may be configured to indicate maintenance may be required based on a number of activations, or based on a component lifetime. In some embodiments, a control system may be configured to send an alert through a mobile app or a dashboard indicating that maintenance may be required based on an activation count threshold, or a time threshold, whichever comes first. In some embodiments, a technician may be able to determine a component remaining lifetime via a mobile app or dashboard.

In some embodiments, a connected system may communicate with an analyst, a janitor, or a technician. A person may remotely operate (e.g. via wireless communication, a computing device dashboard, or combination thereof) a faucet, a collection of faucets, or other components of the connected system. A person may send instructions via a dashboard on one or more of a tablet, mobile device, or computer to a controller associated with a faucet or a collection of faucets. A person may thus control, maintain, and/or repair faucets remotely.

In some embodiments, a faucet or faucet system may include a cleaning or thermal disinfection cycle. A person (e.g. janitor or janitorial staff, homeowner, others) may instruct (e.g., via a computing device dashboard) a faucet or collection of faucets to enter a cleaning mode. A person may send instructions according to a scheduled cleaning program, alternatively, a computer may send programmed instructions automatically according to a predetermined schedule. In an embodiment, a control system is configured to instruct one or more faucets to perform a thermal disinfection cycle, wherein hot water is dispensed from the one or more faucets for a programmed time period. In some embodiments, a cleaning cycle may be performed according to a predetermined schedule; in other embodiments, a cleaning cycle may be performed after a certain number of faucet uses or after a certain volume of water has be dispensed by a faucet.

In certain embodiments, a faucet may be programmed to enter a cleaning mode when a customer checks out of a hotel or lodging room, a signal may be sent to a faucet controller. A faucet or collection of faucets may be cleaned remotely and/or selectively, according to needs of a particular faucet or in response to instructions from a user. Activation of a cleaning mode may allow for simple and fast cleaning of a faucet or faucet system. Performance of a cleaning mode or thermal disinfection cycle may be monitored and recorded by a control system, indicating a faucet or collection of faucets has been cleaned.

Thermal disinfection may be particularly important for facilities in health care settings, for example hospitals, nursing homes, etc., as well as food processing and/or restaurant settings. In some embodiments, a thermal disinfection cycle may comprise dispensing water at a temperature of about 70° C. or greater for a period of from about 5 minutes to about 30 minutes. Such a treatment is effective towards preventing growth and/or killing of bacteria. A disinfection cleaning mode may be programmed to be performed for example once per day, once per week, once per a set number of days, after so many uses, on demand, etc. A disinfection cleaning mode may be programmed to be performed at a time when it is known a faucet will not be in use.

In some embodiments, a control system may be configured to send instructions to a faucet to enter an "auto-purge" mode. An auto-purge mode may comprise periodically purging stagnant water from a faucet and supply lines. Purge frequency may be programmed and adjustable through a mobile app or dashboard. In an embodiment, a purge may comprise dispensing water for several minutes, for example from about 30 seconds to about 2 minutes, or about 3 minutes. A purge frequency may be programmed to occur for example once every 12 or 24 hours. A purge may be instructed on demand.

In an embodiment, a control system may comprise a timer. For example, a timer may record a time a presence sensor is blocked or in a "use" state. In some embodiments, a control system may be configured to instruct a solenoid valve to remain closed if a presence sensor is blocked for an extended time period, for example from about 45 seconds, from about 50 seconds, or from about 55 seconds, to about 60 seconds, or more. A threshold time is programmable, for example programmable via a computer device dashboard or a mobile app.

In some embodiments, a faucet may be configured to enter a "cleaning mode"—different from a thermal disinfection mode. For instance, a technician may shut off a faucet via a computing device in order to clean a sink, faucet, and/or countertop. After cleaning, a technician may be able to re-activate the faucet.

In some embodiments, a drain sensor and/or a flow meter may be in a "sleep" mode, that is, not emitting signals and/or communicating signals to a controller. Upon a presence sensor determining that a user is present, a controller may instruct a drain sensor and/or a flow meter to "wake up" and transmit and receive signals and relay the information to a controller. In some embodiments, a sleep mode may include periodic (regular or irregular intervals) "waking", where a drain sensor and/or a flow meter will emit and receive signals to check for water pressure. If not in a sleep mode, a faucet assembly may be in an active mode, where one or more associated sensors or flow meters are emitting signals and/or communicating signals to a controller.

In some embodiments, a control system may monitor weather and provide instructions to a faucet, collection of faucets, or other components based on the weather. A control system may retrieve information from a cloud (e.g., from a weather service, weather channel, weather application, etc.) as to impending weather. If, for example, the weather is very cold, a control system may be configured to instruct small, periodic releases of water from a faucet to prevent pipes from freezing. In another embodiment, if the weather is very hot and/or if a faucet is continuously or intermittently exposed to the elements, the control system may instruct small, periodic releases of water from a faucet to prevent evaporation of the water within a sink trapway and thus exposure of sewer gases. In another embodiment, if a faucet has not been employed within a programmed time period, for example several days or a week, a control system may be configured to instruct a release of water sufficient to form a water seal in a sink trapway.

A connected system may facilitate maintenance and control of one or more faucets in the system. For example, a system may include all faucets in an office building or on a particular floor of an office building. A control system may monitor each individual faucet and/or sink. A system may use information from a single faucet or sink, or from a group of faucets or sinks, to determine a condition of the plumbing, each faucet or sink, or a collection of faucets or sinks. A control system may notify a facilities manager or other personnel of a condition requiring maintenance, a condition requiring preventive maintenance, identity of problem fixtures or plumbing, in order to minimize water usage and otherwise optimize a building system. In one example, a connected system may be employed in a hospitality setting, such as a hotel or inn. A system may monitor faucets and sinks within the system, perform maintenance and cleaning, place fixtures out of service, and otherwise control the components within the system.

In some embodiments, a connected system may collect, share, and act on information generated from a faucet system as well as external behavior data from other similar or dissimilar systems. Similar systems may include other faucets and/or sinks. Dissimilar systems may include toilets and/or urinals, weather services, date and time management services, etc. For example, during hot summers, a prolonged lack of use of a faucet can result in a sink trapway water seal to evaporate. In such an event, if a sink in a system of faucets and sinks detects a mechanical water seal compromise, the information can be shared with the total system to make necessary adjustment to maintain mechanical water seal. Likewise, during colder winter days, the system can be used to automatically dispense small amounts of water to prevent freezing of the plumbing. In other embodiments, a system is capable of detecting water leaking into a sink trapway and a change in water line pressure. A control system may be configured to notify a technician or analyst of water leaks or other failures. A control system may be configured to automatically adjust faucet water dispensing time to regulate water volume in an event of change in water line pressure. Events may be communicated to a technician or analyst via wireless of wired digital communication methods. Furthermore the current sensing capability may allow reports of abnormal water levels in faucets.

In some embodiments, a controller, a battery, and an antenna are positioned in a housing. An antenna may be associated with a controller and configured to communicate with a computing device and/or a gateway. Communication may be wireless. In some embodiments, each faucet is associated with a single controller and battery, which may be positioned in a housing under a deck or countertop. In other embodiments, a plurality of faucets may be associated with a same controller.

In some embodiments, a faucet or a collection of faucets may be associated with a manual actuator, for example a button, switch, knob, etc. A manual actuator may be positioned on or near a faucet. In other embodiments, a manual actuator may be positioned under a deck or countertop. In some embodiments, a manual actuator may be positioned on a housing having a controller and battery. In some embodiments, a manual actuator may be employed to turn a faucet or collection of faucets on/off. In some embodiments, a manual actuator may be employed to put a faucet or collection of faucets in an active mode (from a sleep mode), in a sleep mode, in a thermal disinfection mode, a cleaning mode, or an auto-purge mode. In some embodiments, a manual actuator may be employed to calibrate a sensor or sensors. In some embodiments, a manual actuator may be in wired electrical communication with a controller.

In some embodiments, a faucet or collection of faucets may be associated with one or more LED light indicators. For example, a light indicator may indicate a battery life or a faucet mode.

In some embodiments, a faucet presence sensor may be in electrical communication with a controller via a wired connection. In some embodiments, a faucet solenoid valve may be in wired electrical communication with a controller. In some embodiments, one or more flow meters associated with a faucet may be in wired electrical communication with a controller.

In some embodiments, a connected system comprising a plurality of faucets may also comprise a plurality of connected toilets. In some embodiments, a connected system may comprise a plurality of connected faucets, a plurality of connected toilets, and a plurality of connected urinals. Connected toilets and urinals may be associated with a controller positioned in a flush valve, configured to wirelessly communicate with a computing device and/or a gateway. A connected system may comprise other connected features, for instance paper towel dispensers, soap dispensers, etc.

A plurality of connected devices may be positioned in a single bathroom, in multiple bathrooms, in most or all bathrooms of a building (e.g. an office building, transportation hub, etc.), most or all bathrooms on an office or college campus, etc.

In some embodiments, a faucet may be configured to be a "stand-alone" device, configured to communicate with a technician's portable computing device. In some embodiments, a stand-alone faucet may be integrated into a connected system through a gateway.

A term "connected" may mean plumbing devices and/or computing devices are able to communicate, either via a wired connection or a wireless connection.

A status may be a normal, operational status, or may be a status indicating attention or maintenance may be required. In some embodiments, a status may be a leak, a slow drain, presence of a user at a faucet, a supply line water pressure, a battery life (e.g. remaining life), a combination thereof, etc.

In some embodiments, a detected status may indicate attention is required. In some embodiments, a connected system may send a message to a technician, for example an e-mail message, providing information regarding which faucet may require what repair or maintenance.

In some embodiments, certain events are recorded, stored, and reported via a control system. For example, events may include a total number of faucet uses (e.g. presence sensor activations) in a certain time period, total number of faucet uses since installation, total number of activations since battery change, total run time (water dispensing time) in hours since installation; total number of leak events since installation, total number of leak events over a certain time period, total number of slow drain events since installation, total number of slow drain events over a certain time period, and total number of events having timestamps for auto-purge, cleaning mode activation, thermal disinfection, safety timer activation, low battery events, and battery replacements. A certain time period may be for example a last 30 days, a last 60 days, a last 120 days, a last 180 days, etc.

In some embodiments, a total water usage may be determined by counting a number of presence sensor activations.

Following are some non-limiting embodiments.

In a first embodiment, disclosed is a connected faucet system, comprising a plurality of faucets, each faucet associated with a presence sensor, a solenoid valve, a flow meter, and a controller, wherein the presence sensor, the solenoid valve, and the flow meter are in electrical communication with the controller; and a control system comprising the controllers and a computing device, wherein the controllers are configured to communicate with the computing device directly and/or via a gateway, the control system is configured to collect data from the presence sensors and the flow meters, and the control system is configured to determine a status of each faucet based on the data. In an embodiment, each faucet of a plurality of faucets may be associated with a presence sensor of a plurality of presence sensors, with a solenoid valve of a plurality of solenoid valves, and with a flow meter of a plurality of flow meters. In an embodiment, each faucet of a plurality of faucets may be associated with a controller of a plurality of controllers. In another embodiment, a single controller may be associated with a plurality of faucets. In some embodiments, each faucet may be associated with a flow meter associated with a hot water source and with a flow meter associated with a cold water source.

In a second embodiment, disclosed is a connected system according to embodiment 1, wherein the connected system comprises a plurality of faucets and a plurality of toilets. In a third embodiment, disclosed is a connected system according to embodiments 1 or 2, wherein the connected system comprises a plurality of faucets, a plurality of toilets, and a plurality of urinals.

In a fourth embodiment, disclosed is a connected system according to any of the preceding embodiments, wherein the plurality of faucets comprises a collection of faucets in a bathroom, a collection of faucets in multiple bathrooms, or a collection of faucets in multiple buildings.

In a fifth embodiment, disclosed is a connected system according to any of the preceding embodiments, wherein the control system is configured to initiate an action based on the status. In a sixth embodiment, disclosed is a connected system according to any of the preceding embodiments, wherein a technician may initiate an action via the computing device.

In a seventh embodiment, disclosed is a connected system according to any of the preceding embodiments, wherein the computing device comprises a desktop computer, a laptop computer, mobile device, or a combination thereof.

In an eighth embodiment, disclosed is a connected system according to any of the preceding embodiments, wherein the status is selected from a leak detection, a slow drain, a faucet usage, a supply line water pressure, a battery life, and combinations thereof, and wherein the control system is configured to initiate an action based on the status.

In a ninth embodiment, disclosed is a connected system according to any of the preceding embodiments, wherein the control system is configured to initiate an action based on the status, and wherein the action is selected from instructing the solenoid valve to open, instructing the solenoid valve to close, initiating a service ticket, adjusting a duration of time a valve remains open, monitoring usage of a bathroom, instructing an angle stop to close, sending a message to a technician, and combinations thereof.

In a tenth embodiment, disclosed is a connected system according to any of the preceding embodiments, wherein the controllers are configured to communicate with a cloud/server via a gateway. In an eleventh embodiment, disclosed is a connected system according to any of the preceding embodiments, wherein the computing device is configured to communicate with a cloud/server.

In a twelfth embodiment, disclosed is a connected system according to any of the preceding embodiments, wherein the computing device is configured to send instructions to the controller, and the controller is configured to initiate an action in response.

In a thirteenth embodiment, disclosed is a connected system according to embodiment 10, wherein the cloud/server is configured to send instructions to the controller via the gateway, and the controller is configured to initiate an action in response.

In a fourteenth embodiment, disclosed is a connected system according to embodiment 11, wherein the computing device is configured to receive instructions from the cloud/server and to send the instructions to the controller, and wherein the controller is configured to initiate an action in response.

In a fifteenth embodiment, disclosed is a connected system according to embodiment 10, wherein the computing device or the cloud/server is configured to send instructions to the controller based on programmed instructions and/or data stored on the computing device or the cloud/server.

In a sixteenth embodiment, disclosed is a connected system according to embodiment 11, wherein the computing device or the cloud/server is configured to send instructions to the controller based on programmed instructions and/or data stored on the computing device or the cloud/server.

In a seventeenth embodiment, disclosed is a connected system according to any of the preceding embodiments, wherein the control system is configured to analyze, aggregate, store, and log the data.

In an eighteenth embodiment, disclosed is a connected system according to any of the preceding embodiments, wherein the control system comprises a dashboard having visual modules and configured to monitor, display, and analyze the data.

In a nineteenth embodiment, disclosed is a connected system according to any of the preceding embodiments, wherein the control system is configured to monitor data selected from historical data, performance over time, bathroom traffic, faucet or sink usage, sanitary ware usage, and combinations thereof.

In a twentieth embodiment, disclosed is a connected system according to any of the preceding embodiments, wherein the control system is configured to provide a daily, monthly, or yearly status of an individual faucet or of the plurality of faucets.

In a twenty-first embodiment, disclosed is a connected system according to any of the preceding embodiments, wherein the control system is configured to allow a technician to monitor the status of the faucets remotely with the computing device.

In a twenty-second embodiment, disclosed is a connected system according to any of the preceding embodiments, wherein the control system is configured to initiate an action based on the status, external data, or a combination thereof. In a twenty-third embodiment, disclosed is a connected system according to embodiment 22, wherein the external data is data from weather services or from date and time management services.

In a twenty-fourth embodiment, disclosed is a connected system according to any of the preceding embodiments, wherein the control system is configured to instruct one or more faucets to perform a thermal disinfection cycle, wherein hot water is dispensed from the one or more faucets for a programmed time period.

In a twenty-fifth embodiment, disclosed is a connected system according to any of the preceding embodiments, comprising a flow meter associated with a faucet hot water source and a flow meter associated with a cold water source, both positioned upstream of the solenoid valve.

In a twenty-sixth embodiment, disclosed is a connected system according to any of the preceding embodiments, wherein the control system is configured to monitor the flow meter after the solenoid valve has been moved from an open position to a closed position, and to recognize a leak event if the flow meter indicates water flow above a threshold flow rate.

In a twenty-seventh embodiment, disclosed is a connected system according to any of the preceding embodiments, comprising a plurality of sinks associated with the faucets, wherein each sink is associated with a drain sensor configured to detect a slow drain.

In a twenty-eighth embodiment, disclosed is a connected system according to any of the preceding embodiments, wherein the presence sensor is an infrared sensor or a capacitive sensor.

In a twenty-ninth embodiment, disclosed is a connected system according to any of the preceding embodiments, wherein the flow meter comprises a pressure sensor, a Hall Effect sensor, or an ultrasonic sensor.

In a thirtieth embodiment, disclosed is a connected system according to any of the preceding embodiments, wherein one or more faucets of the plurality of faucets comprises a flow regulator aerator.

In a thirty-first embodiment, disclosed is a connected system according to any of the preceding embodiments, wherein one or more faucets may be in a faucet mode selected from a thermal disinfection mode, a cleaning mode, an active mode, a sleep mode, or an auto-purge mode.

In a thirty-second embodiment, disclosed is a connected system according to any of the preceding embodiments, wherein one or more faucets are associated with a manual actuator, the manual actuator configured to place a faucet in a faucet mode.

Following is another set of non-limiting embodiments.

In a first embodiment, disclosed is a faucet system, comprising a faucet associated with a presence sensor, a solenoid valve, a flow meter, and a controller, wherein the presence sensor, the solenoid valve, and the flow meter are in electrical communication with the controller, wherein the controller is configured to be in wireless communication with a computing device and/or with a gateway.

In a second embodiment, disclosed is a faucet system according to the first embodiment, wherein the gateway is configured to be in wireless communication with a cloud/server, and wherein the cloud/server is configured to be in wireless communication with the computing device. In a third embodiment, disclosed is a faucet system according to the first or second embodiments, wherein wireless communication is two-way.

In a fourth embodiment, disclosed is a faucet system according to any of the preceding embodiments, wherein the faucet is associated with a sink, and wherein the sink is associated with a drain sensor configured to detect a slow drain. In a fifth embodiment, disclosed is a faucet system according to the fourth embodiment, wherein the drain sensor comprises a capacitive sensor or an ultrasonic sensor. In a sixth embodiment, disclosed is a faucet system according to the fourth or fifth embodiments, wherein the drain sensor is positioned on a sink underside or on a sink trapway. In a seventh embodiment, disclosed is a faucet system according to any of embodiments 4 to 6, wherein the drain sensor is in electrical communication with the controller.

In an eighth embodiment, disclosed is a faucet system according to any of the preceding embodiments, comprising a plurality of the faucets.

In a ninth embodiment, disclosed is a faucet system according to any of the preceding embodiments, wherein a control system comprising the controller, the computing device, and the cloud/server is configured to collect data from the presence sensor and flow meter, and to determine a status of the faucet based on the data.

In a tenth embodiment, disclosed is a faucet system according to any of the preceding embodiments, wherein a control system comprising the controller, the computing device, and the cloud/server is configured to collect data from the presence sensor, flow meter, and drain sensor and to determine a status of the faucet based on the data.

In an eleventh embodiment, disclosed is a faucet system according to any of the preceding embodiments, comprising a plurality of the faucets, wherein the faucets comprise a collection of faucets in a bathroom, a collection of faucets in multiple bathrooms, or a collection of faucets in multiple buildings.

In a twelfth embodiment, disclosed is a faucet system according to embodiments 9 or 10, wherein the control system is configured to initiate an action based on the status. In a thirteenth embodiment, disclosed is a faucet system according to any of the preceding embodiments, wherein a technician may initiate an action via the computing device.

In a fourteenth embodiment, disclosed is a faucet system according to any of the preceding embodiments, wherein the computing device comprises a desktop computer, a laptop computer, mobile device, or a combination thereof.

In a fifteenth embodiment, disclosed is a faucet system according to any of embodiments 9, 10, or 12, wherein the status is selected from a leak detection, a slow drain, a faucet usage, a supply line water pressure, a battery life, and combinations thereof.

In a sixteenth embodiment, disclosed is a faucet system according to any of embodiments 9, 10, or 12, wherein the control system is configured to initiate an action based on the status, and wherein the action is selected from instructing the solenoid valve to open, instructing the solenoid valve to close, initiating a service ticket, adjusting a duration of time a valve remains open, monitoring usage of a bathroom, instructing an angle stop to close, sending a message to a technician, and combinations thereof.

In a seventeenth embodiment, disclosed is a faucet system according to any of the preceding embodiments, wherein the controller is configured to communicate with a cloud/server via the gateway. In an eighteenth embodiment, disclosed is a faucet system according to any of the preceding embodiments, wherein the computing device is configured to communicate with a cloud/server.

In a nineteenth embodiment, disclosed is a faucet system according to any of the preceding embodiments, wherein the computing device is configured to send instructions to the controller, and the controller is configured to initiate an action in response.

In a twentieth embodiment, disclosed is a faucet system according to embodiment 17, wherein the cloud/server is configured to send instructions to the controller via the gateway, and the controller is configured to initiate an action in response. In a twenty-first embodiment, disclosed is a faucet system according to embodiment 18, wherein the computing device is configured to receive instructions from the cloud/server and to send instructions to the controller, and wherein the controller is configured to initiate an action in response.

In a twenty-second embodiment, disclosed is a faucet system according to embodiment 17, wherein the computing device or the cloud/server is configured to send instructions to the controller based on programmed instructions and/or data stored on the computing device or the cloud/server. In a twenty-third embodiment, disclosed is a faucet system according to embodiment 18, wherein the computing device or the cloud/server is configured to send instructions to the controller based on programmed instructions and/or data stored on the computing device or the cloud/server.

In a twenty-fourth embodiment, disclosed is a faucet system according to any of embodiments 9, 10, 12, or 16, wherein the control system is configured to analyze, aggregate, store, and log the data. In a twenty-fifth embodiment, disclosed is a faucet system according to any of embodiments 9, 10, 12, 16, or 24, wherein the control system comprises a dashboard having visual modules and configured to monitor, display, and analyze the data.

In a twenty-sixth embodiment, disclosed is a faucet system according to any of embodiments 9, 10, 12, 16, 24, or 25, wherein the control system is configured to monitor data selected from historical data, performance over time, bathroom traffic, faucet or sink usage, sanitary ware usage, and combinations thereof. In a twenty-seventh embodiment, disclosed is a faucet system according to any of embodiments 9, 10, 12, 16, or 24-26, wherein the control system is configured to provide a daily, monthly, or yearly status of an individual faucet or of the plurality of faucets.

In a twenty-eighth embodiment, disclosed is a faucet system according to any of embodiments 9, 10, 12, 16, or 24-27, wherein the control system is configured to allow a technician to monitor the status of the faucets remotely with the computing device.

In a twenty-ninth embodiment, disclosed is a faucet system according to any of embodiments 9, 10, 12, 16, or 24-28, wherein the control system is configured to initiate an action based on the status, external data, or a combination thereof. In a thirtieth embodiment, disclosed is a faucet system according to embodiment 29, wherein the external data is data from weather services or from date and time management services.

In a thirty-first embodiment, disclosed is a connected system according to any of embodiments 9, 10, 12, 16, or 24-30, wherein the control system is configured to instruct the faucets to perform a thermal disinfection cycle, wherein hot water is dispensed from the one or more faucets for a programmed time period.

In a thirty-second embodiment, disclosed is a faucet system according to any of the preceding embodiments, comprising a flow meter associated with a faucet hot water source and a flow meter associated with a cold water source, both positioned upstream of the solenoid valve.

In a thirty-third embodiment, disclosed is a faucet system according to any of embodiments 9, 10, 12, 16, or 24-32, wherein the control system is configured to monitor the flow meter after the solenoid valve has been moved from an open position to a closed position, and to recognize a leak event if the flow meter indicates water flow above a threshold flow rate.

In a thirty-fourth embodiment, disclosed is a faucet system according to any of the preceding embodiments, wherein the presence sensor is an infrared sensor or a capacitive sensor. In a thirty-fifth embodiment, disclosed is a faucet system according to any of the preceding embodiments, wherein the flow meter comprises a pressure sensor, a Hall Effect sensor, or an ultrasonic sensor.

In a thirty-sixth embodiment, disclosed is a faucet system according to any of the preceding embodiments, wherein the faucet comprises a flow regulator aerator.

In a thirty-seventh embodiment, disclosed is a faucet system according to any of the preceding embodiments, wherein the faucet is configured to be in a mode selected from a thermal disinfection mode, a cleaning mode, an active mode, a sleep mode, or an auto-purge mode.

In a thirty-eighth embodiment, disclosed is a faucet system according to any of the preceding embodiments, wherein the faucet is associated with a manual actuator, the manual actuator configured to place a faucet in a faucet mode.

The term "flow communication" or "fluid communication" means for example configured for liquid or gas flow therethrough and may be synonymous with "fluidly coupled". The terms "upstream" and "downstream" indicate a direction of gas or fluid flow, that is, gas or fluid will flow from upstream to downstream.

Likewise, "electrical communication" may mean "electrically coupled". Electrical communication may be via wired connection or may be wireless.

The terms "coupled" or "connected" may mean that an element is "attached to" or "associated with" another element. Coupled or connected may mean directly coupled or coupled through one or more other elements. An element may be coupled to an element through two or more other elements in a sequential manner or a non-sequential manner. The term "via" in reference to "via an element" may mean "through" or "by" an element. Coupled or connected or "associated with" may also mean elements not directly or indirectly attached, but that they "go together" in that one may function together with the other.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A connected faucet system comprising a plurality of faucets and a control system, wherein each faucet of the plurality of faucets is associated with a presence sensor, a solenoid valve, a flow meter, and a controller, the presence sensor, the solenoid valve, and the flow meter are in electrical communication with the controller, the flow meter is positioned upstream of the solenoid valve, the control system comprises the controller and a computing device, the controllers is configured to communicate with the computing device directly and/or via a gateway, the control system is configured to collect data from the presence sensor and the flow meter, the control system is configured to determine a status of each faucet based on the data, and the control system is configured to monitor the flow meter after the faucet associated with the flow meter and the solenoid valve has been used, and the solenoid valve has been moved from an open position to a closed position, and to recognize a leak event if the flow meter indicates water flow above a threshold rate.

2. The connected faucet system according to claim 1, wherein the controller is configured to be in wireless communication with the computing device and the gateway, the gateway is configured to be in wireless communication with a cloud/server, the cloud/server is configured to be in wireless communication with the computing device, and the controller is configured to communicate with the cloud/server via the gateway.

3. The connected faucet system according to claim 2, wherein the computing device and the cloud/server are configured to send instructions to the controller, and the controller is configured to initiate an action in response.

4. The connected faucet system according to claim 3, wherein the computing device and/or the cloud/server are configured to send instructions to the controller based on programmed instructions and/or data stored on the computing device or the cloud/server.

5. The connected faucet system according to claim 3, wherein the computing device is configured to receive instructions from the cloud/server and to send the instructions to the controller, and wherein the controller is configured to initiate an action in response.

6. The connected faucet system according to claim 1, wherein the status is selected from a leak detection, a slow drain, a faucet usage, a supply line water pressure, a battery life, and combinations thereof, and wherein the control system is configured to initiate an action based on the status.

7. The connected faucet system according to claim 1, wherein the control system is configured to initiate an action based on the status, and wherein the action is selected from instructing the solenoid valve to open, instructing the solenoid valve to close, initiating a service ticket, adjusting a duration of time a valve remains open, monitoring usage of a bathroom, instructing an angle stop to close, sending a message to a technician, and combinations thereof.

8. The connected faucet system according to claim 1, wherein the control system is configured to allow a technician to monitor the status of each faucet remotely via the computing device.

9. The connected faucet system according to claim 1, wherein a technician may initiate an action remotely via the computing device.

10. The connected faucet system according to claim 1, wherein the control system comprises a dashboard having visual modules and configured to monitor, display, and analyze the data.

11. The connected faucet system according to claim 1, comprising a sink associated with each faucet, wherein the sink is associated with a drain sensor configured to detect a slow drain.

12. The connected faucet system according to claim 1, wherein the control system is configured to instruct one or more faucets of the plurality of faucets to perform a thermal disinfection cycle, wherein hot water is dispensed from the one or more faucets for a programmed period of time.

13. The connected faucet system according to claim 1, wherein one or more faucets of the plurality of faucets may be in a faucet mode selected from a thermal disinfection mode, a cleaning mode, an active mode, a sleep mode, and an auto-purge mode.

14. The connected faucet system according to claim 1, wherein one or more faucets of the plurality of faucets are associated with a manual actuator, the manual actuator configured to place a faucet in a faucet mode.

15. The connected faucet system according to claim 1, wherein the threshold flow rate is about 0.5 liters/min.

16. The connected faucet system according to claim 1, comprising a first flow meter associated with a faucet hot water source and a second flow meter associated with a cold water source, both positioned upstream of the solenoid valve.

17. The connected faucet system according to claim 1, wherein the control system is configured to analyze, aggregate, store, and log the data.

18. The connected faucet system according to claim 1, wherein the control system is configured to monitor data selected from historical data, performance over time, bathroom traffic, faucet or sink usage, sanitary ware usage, and combinations thereof.

19. The connected faucet system according to claim 1, wherein the control system is configured to provide a daily, monthly, or yearly status of an individual faucet or of the plurality of faucets.

20. The faucet system according to claim 1, wherein the flow meter comprises a pressure sensor, a Hall Effect sensor, or an ultrasonic sensor.

* * * * *